US006868787B2

(12) United States Patent
Mori

(10) Patent No.: US 6,868,787 B2
(45) Date of Patent: Mar. 22, 2005

(54) PRINTING PLATE PRECURSOR AND PRINTING PLATE

(75) Inventor: Takahiro Mori, Hachiouji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/359,776

(22) Filed: Feb. 6, 2003

(65) Prior Publication Data

US 2003/0167950 A1 Sep. 11, 2003

(30) Foreign Application Priority Data

Feb. 12, 2002 (JP) ..... 2002-033870

(51) Int. Cl.[7] ..... B41N 1/00
(52) U.S. Cl. ..... 101/453; 101/456
(58) Field of Search ..... 101/453, 454, 101/455, 458, 459, 465, 466, 467

(56) References Cited

U.S. PATENT DOCUMENTS 3,511,661 A * 5/1970 Rauner et al. ..... 430/278.1
5,881,645 A * 3/1999 Lenney et al. ..... 101/463.1
5,967,047 A * 10/1999 Kuhn et al. ..... 101/454
6,019,045 A * 2/2000 Kato et al. ..... 101/466
6,176,182 B1 * 1/2001 Nakayama et al. ..... 101/375
6,357,351 B1 * 3/2002 Bhambra et al. ..... 101/455
6,386,104 B1 * 5/2002 Kasai et al. ..... 101/375
6,475,630 B1 * 11/2002 Uesugi et al. ..... 428/472
6,494,137 B2 * 12/2002 Sawada et al. ..... 101/459
6,564,712 B2 * 5/2003 Sato et al. ..... 101/462

FOREIGN PATENT DOCUMENTS

EP 1 075 942 A2 2/2001
EP 1 167 062 A2 1/2002

* cited by examiner

*Primary Examiner*—Stephen R. Funk
(74) *Attorney, Agent, or Firm*—Muserlian, Lucas and Mercanti

(57) ABSTRACT

Disclosed is a printing plate precursor composed of a substrate and provided thereon, a hydrophilic layer having a center line average roughness Ra of from 150 nm to less than 1000 nm and having effective protrusions of from 500 to less than 3000 per $mm^2$, the effective protrusions protruding from an upper plane 1.0 $\mu$m farther from the substrate than a center roughness plane in the three dimensional roughness plane of the hydrophilic layer, and having a ratio H/D of not less than 0.15, wherein H represents a height ($\mu$m) from the upper plane of the effective protrusions, and D represents a size ($\mu$m) of solids formed by the upper plane and the curved surface protruding from the upper plane of the effective protrusions.

13 Claims, No Drawings

PRINTING PLATE PRECURSOR AND PRINTING PLATE

FIELD OF THE INVENTION

The present invention relates to a printing plate precursor and a printing plate, and particularly to a printing plate precursor capable of forming an image by a computer to plate (CTP) system and a printing plate forming an image by a CTP system.

BACKGROUND OF THE INVENTION

The printing plate precursor for CTP, which is inexpensive, can be easily handled, and has a printing ability comparable with that of a PS plate, is required accompanied with the digitization of printing data. Recently, a so-called processless printing plate precursor has been noticed which can be applied to a printing press employing a direct imaging (DI) process and does not require development by a special developing agent.

In the processless printing plate precursor, the same grained aluminum plate as in a PS plate is considered to be used as a hydrophilic substrate, but various printing plate precursors comprising a substrate and a hydrophilic layer coated thereon have been proposed in view of freedom of layer constitution and cost reduction.

As one of the image formation methods employing a processless printing plate precursor, an infrared laser image formation method is preferred, and the methods are generally classified into three methods, an ablation method described later, a heat fusion image formation on press development method and a heat melt image transfer method.

The infrared laser image formation method enables forming an image with high resolution in a short time, but has problem in that an exposure device used is expensive.

As the ablation methods, there are methods, as disclosed in for example, Japanese Patent O.P.I. Publication Nos. 8-507727, 6-186750, 6-199064, 7-314934, 10-58636 and 10-244773. These references disclose a printing plate precursor comprising a substrate and a hydrophilic layer or a lipophilic layer as an outermost layer. In the printing plate precursor having a hydrophilic layer as an outermost layer, the hydrophilic layer is imagewise exposed to imagewise ablate the hydrophilic layer, whereby the lipophilic layer is exposed to form image portions. However, there are problem that contamination of the interior of the exposing apparatus by scattered matter caused by the ablation of the surface layer. In order to prevent such a scattered matter caused by the ablation of the surface layer, there is a method in which a water soluble protective layer is further provided on the hydrophilic layer and then the ablated layer is removed together with the protective layer on the printing press.

As the heat fusion image formation on press development method, there is a method employing a printing plate precursor, disclosed in, for example, Japanese Patent Nos. 2938397 and 2938398, which comprises an image forming layer containing thermoplastic polymer particles and a water soluble binder on the hydrophilic layer or on a grained aluminum plate. However, such a printing plate, when a grained aluminum plate is used as a hydrophilic substrate, is required to contain a light heat conversion material (generally colored) in the image forming layer, and may contaminate a printing press in development on press. In this case, a printing plate precursor is advantageous which comprises a substrate and provided thereon, a hydrophilic layer containing a light heat conversion material and an image forming layer containing no light heat conversion material.

As the heat melt image transfer method, there is a method in which a heat melt material is imagewise transferred onto a hydrophilic surface of a metal sleeve which can be repeatedly used, not on a grained aluminum surface, through a heat transfer ribbon such as DICO web produced by Mannroland Co., Ltd., and heated to fix the resulting image.

As described above, any type image recording methods use a plate precursor having a hydrophilic layer as a water receiving surface at non-exposed portions as a processless printing plate for infrared recording.

As an image formation method employing the processless printing plate precursor, there have been various proposed methods including an ink jet recording method. The ink jet recording method does not provide a high speed recording or high resolution obtained by an infrared recording, but has advantage in cheapness.

A processless plate employing an ink jet recording process is a printing plate manufactured by imagewise providing an oleophilic image formation material onto a hydrophilic layer of a plate precursor to form an image and optionally carrying out fixing treatment or treatment for increasing strength of the formed image. As ink containing an image formation material, there is a photopolymerizable ink disclosed in Japanese Patent O.P.I. Publication No. 5-204138, a hot melt ink disclosed in Japanese Patent O.P.I. Publication No. 9-58144, or an oily ink disclosed in Japanese Patent O.P.I. Publication Nos. 10-272753. As a printing plate precursor having a hydrophilic surface, there is a grained aluminum plate or a printing plate precursor having a hydrophilic layer on the support. A printing plate precursor is advantageous for the ink jet recording process which comprises a porous hydrophilic layer, since a suitable ink absorption property is required for a printing plate precursor to prevent ink provided on the printing plate precursor from bleeding or to properly fix the provided ink.

As a processless plate employing various image formation methods, a printing plate precursor having a hydrophilic layer coated on a support is more suitable than that having a grained aluminum plate.

Various studies on a grained aluminum plate have been made, and as a result, an aluminum plate providing excellent printing properties has been obtained. However, although many studies on a hydrophilic layer have been made, a hydrophilic layer providing an excellent performance identical to the grained aluminum plate has not yet been obtained.

The grained aluminum plate has a multiple roughness structure from sub microns to scores of microns, which increases latitude of dampening water ink balance during printing and prevents printed images from abrading to improve printing durability. Proposal has been made which provides a specific shape to a hydrophilic layer. For example, Japanese Patent No. 3019366 discloses a hydrophilic layer having a specific surface roughness and waviness index. Japanese Patent O.P.I. Publication No. 9-99662 discloses a hydrophilic layer with a three dimensional network structure and a void content of from 30 to 80% which contains inorganic particles with a particle size of not more than 100 nm and a water soluble resin. However, these hydrophilic layers have a simple surface shape, and inferior to the grained aluminum plate. Thus, it has been difficult to give a multiple surface roughness to a hydrophilic layer according to the prior art.

SUMMARY OF THE INVENTION

The present invention has been made in view of the above. An aspect of the invention is to provide a printing plate precursor with a hydrophilic layer having scratch resistance and rubber scratch resistance which are comparable to a grained aluminum plate and high printing durability and a printing plate manufactured from the printing plate precursor.

DETAILED DESCRIPTION OF THE INVENTION

The above object has been attained by one of the following constitutions:

1. A printing plate precursor comprising a substrate and provided thereon, a hydrophilic layer having a center line average roughness Ra of from 150 nm to less than 1000 nm and having effective protrusions of from 500 to less than 3000 per $mm^2$, the effective protrusions protruding from an upper plane 1.0 $\mu$m farther from the substrate than a center roughness plane in the three dimensional roughness plane of the hydrophilic layer, and having a ratio H/D of not less than 0.15, wherein H represents a height ($\mu$m) from the upper plane of the effective protrusions, and D represents a size ($\mu$m) of solids formed by the upper plane and the curved surface protruding from the upper plane of the effective protrusions.
2. The printing plate precursor of item 1 above, wherein the surface of the hydrophilic layer has a skewness Rsk exceeding 2.
3. The printing plate precursor of item 1 above, wherein the hydrophilic layer contains a hydrophilic matrix phase and inorganic particles or inorganic material coated particles each particle having a particle size of not less than 1 $\mu$m, and satisfies the following inequality (1):

$$P1-M1>1.0 \qquad \text{Inequality (1)}$$

wherein M1 represents an average thickness ($\mu$m) of the hydrophilic matrix phase in the hydrophilic layer, and P1 represents an average particle size ($\mu$m) of the inorganic particles or the inorganic material coated particles contained in the hydrophilic layer.

4. The printing plate precursor of item 1 above, further comprising an under layer, wherein the under layer and the hydrophilic layer are provided in that order on the substrate, the under layer containing a hydrophilic matrix phase and inorganic particles or inorganic material coated particles each particle having a particle size of not less than 1 $\mu$m, and the hydrophilic layer containing a hydrophilic matrix phase, wherein the following inequality (2) is satisfied:

$$P2-(M1+M2)>1.0 \qquad \text{Inequality (2)}$$

wherein M1 represents an average thickness ($\mu$m) of the hydrophilic matrix phase in the hydrophilic layer, M2 represents an average thickness ($\mu$m) of the hydrophilic matrix phase in the under layer, and P2 represents an average particle size ($\mu$m) of the inorganic particles or inorganic material coated particles each particle having a size of not more than 1 $\mu$m contained in the under layer.

5. The printing plate precursor of item 1 above, wherein an under layer is provided on the hydrophilic layer, both under layer and hydrophilic layer containing a hydrophilic matrix phase and inorganic particles or inorganic material coated particles each particle having a particle size of not less than 1 $\mu$m, wherein the following inequalities (1) and (2) are satisfied:

$$P1-M1>1.0$$

wherein M1 represents an average thickness ($\mu$m) of the hydrophilic matrix phase in the hydrophilic layer, and P1 represents an average particle size ($\mu$m) of the inorganic particles or inorganic material coated particles each particle having a size of not more than 1 $\mu$m contained in the hydrophilic layer, $$P2-(M1+M2)>1.0 \qquad \text{Inequality (2)}$$

wherein M1 represents an average thickness ($\mu$m) of the hydrophilic matrix phase in the hydrophilic layer, M2 represents an average thickness ($\mu$m) of the hydrophilic matrix phase in the under layer, and P2 represents an average particle size ($\mu$m) of the inorganic particles or inorganic material coated particles each particle having a size of not more than 1 $\mu$m contained in the under layer.

6. The printing plate precursor of item 1 above, wherein the hydrophilic matrix phase in the hydrophilic layer has a regular convexoconcave structure.
7. The printing plate precursor of item 1 above, wherein the hydrophilic layer has a porous structure.
8. The printing plate precursor of item 1 above, further comprising on the substrate an image formation layer capable of forming an image by heat application, wherein at least one of layers provided on the substrate contains a light heat conversion material.
9. The printing plate precursor of item 8 above, the image formation layer being provided on the hydrophilic layer, wherein the image formation layer contains heat melting particles or heat fusible particles.
10. The printing plate precursor of item 8 above, wherein the image formation layer contains an oligosaccharide.
11. A printing plate which is manufactured by imagewise providing an image formation material on a hydrophilic layer of a printing plate precursor to form an image on the hydrophilic layer, the printing plate precursor comprising a substrate and provided thereon, a hydrophilic layer having a center line average roughness Ra of from 150 nm to less than 1000 nm and having effective protrusions of from 500 to less than 3000 per $mm^2$, the effective protrusions protruding from an upper plane 1.0 $\mu$m farther from the substrate than a center roughness plane in the three dimensional roughness plane of the hydrophilic layer, and having a ratio H/D of not less than 0.15, wherein H represents a height ($\mu$m) from the upper plane of the effective protrusions, and D represents a size ($\mu$m) of solids formed by the upper plane and the curved surface protruding from the upper plane of the effective protrusions.
12. The printing plate of item 11 above, wherein the image is formed by imagewise providing ink containing an image formation material on the hydrophilic layer according to an ink jet process.
13. The printing plate of item 12 above, wherein the ink is a radiation curable ink.
14. The printing plate of item 13 above, wherein after the radiation curable ink is imagewise provided on the hydrophilic layer of the printing plate precursor according to an ink jet process, the resulting printing plate precursor is exposed to light.

21. A printing plate precursor comprising a substrate and provided thereon, a hydrophilic layer having a center line average roughness Ra of from 150 nm to less than 1000 nm and having effective protrusions of from 500 to less than 3000 per $mm^2$, the effective protrusions protruding from an upper plane 1.0 μm farther from the substrate than a center roughness plane in the three dimensional roughness plane of the hydrophilic layer, and having a ratio H/D of not less than 0.15, wherein H represents a height from the upper plane of the effective protrusions, and D represents a size of solids formed by the upper plane and the curved surface protruding from the upper plane of the effective protrusions.

22. The printing plate precursor of item 21 above, wherein the surface of the hydrophilic layer has a skewness Rsk exceeding 2.

23. The printing plate precursor of item 21 or 22 above, wherein the hydrophilic layer contains a hydrophilic matrix phase and inorganic particles or inorganic material coated particles each particle having a particle size of not less than 1 μm, and satisfies the following inequality (1):

$$P1-M1>1.0 \qquad \text{Inequality (1)}$$

wherein M1 represents an average thickness (μm) of the hydrophilic matrix phase in the hydrophilic layer, and P1 represents an average particle size (μm) of the inorganic particles or the inorganic material coated particles contained in the hydrophilic layer.

24. The printing plate precursor of item 21 or 22 above, wherein an under layer and the hydrophilic layer are provided in that order on the substrate, the under layer containing a hydrophilic matrix phase and inorganic particles or inorganic material coated particles each particle having a particle size of not less than 1 μm, and the hydrophilic layer containing a hydrophilic matrix phase, wherein the following inequality (2) is satisfied:

$$P2-(M1+M2)>1.0 \qquad \text{Inequality (2)}$$

wherein M1 represents an average thickness (μm) of the hydrophilic matrix phase in the hydrophilic layer, M2 represents an average thickness (μm) of the hydrophilic matrix phase in the under layer, and P2 represents an average particle size (μm) of the inorganic particles or inorganic material coated particles each particle having a size of not more than 1 μm contained in the under layer.

25. The printing plate precursor of item 21 or 22 above, wherein an under layer and the hydrophilic layer are provided in that order on the substrate, both under layer and hydrophilic layer containing a hydrophilic matrix phase and inorganic particles or inorganic material coated particles each particle having a particle size of not less than 1 μm, wherein the above described inequalities (1) and (2) are satisfied.

26. The printing plate precursor of any one of items 21 through 25 above, wherein the hydrophilic matrix phase in the hydrophilic layer has a regular convexo-concave structure.

27. The printing plate precursor of any one of items 21 through 26 above, wherein the hydrophilic layer has a porous structure.

28. The printing plate precursor of any one of items 21 through 27 above, further comprising on the substrate an image formation layer capable of forming an image by heat application, wherein at least one of layers provided on the substrate contains a light heat conversion material.

29. The printing plate precursor of item 28 above, the image formation layer being provided on the hydrophilic layer, wherein the image formation layer contains heat melting particles or heat fusible particles.

30. A printing plate which is manufactured by imagewise providing an image formation material on the hydrophilic layer of the printing plate precursor of any one of items 21 through 27 above to form an image on the hydrophilic layer.

31. The printing plate of item 30 above, wherein the image is formed by imagewise providing ink containing an image formation material on the hydrophilic layer according to an ink jet process.

32. The printing plate of item 31 above, wherein the ink is a radiation curable ink.

33. The printing plate of item 32 above, wherein after the radiation curable ink is imagewise provided on the hydrophilic layer of the printing plate precursor according to an ink jet process, the resulting printing plate precursor is exposed to light.

The present inventor has made an extensive study on parameters of various surface roughness and shapes of the hydrophilic layer of the printing plate precursor which relates to printability or printing durability, and found that effective protrusions described later in the hydrophilic layer participate in these characteristics.

The effective protrusions in the invention refers to protrusions in a hydrophilic layer having a center line average roughness Ra of from 150 nm to less than 1000 nm on a substrate, the protrusions protruding from an upper plane 1.0 μm farther from the substrate than a center roughness plane in the three dimensional roughness plane of the hydrophilic layer, and having a ratio H/D of not less than 0.15, wherein H represents a height (μm) from the upper plane of the protrusions, and D represents a size (μm) of solids formed by the upper plane and the curved surface of the protrusions which protrudes from the upper plane. Herein, H and D are measured employing a non-contact surface roughness measuring apparatus RST Plus, manufactured by WYKO Co., Ltd. D is obtained as follows:

The surface of a printing plate precursor being scanned in a given direction X and in a direction Y normal to the direction X in the non-contact surface roughness measuring apparatus RST Plus, a length Lx (μm) in the direction X of the solids described above, and a length Ly (μm) in the direction Y of the solids are determined. D is represented by the average of Lx and Ly.

Practically, it is only the vertices of the protrusions in the printing plate that contact a dampening roller, an ink roller and a blanket during printing. This shows that the shape of the protrusion vertex or the outermost surface of the protrusions protruding from an upper plane 1.0 μm farther from the substrate than a center roughness plane in the three dimensional roughness plane of the hydrophilic layer has an influence on the printability or printing durability. The ratio H/D of not less than 0.15 in the invention shows that a radius of curvature of the protrusions protruding from the upper plane is small, or the protrusion vertex is relatively sharp. The present inventor has found that the relatively sharp protrusion vertex has an influence on various printing properties, and as a result, the parameters of the shape of the protrusion vertex have been defined described above.

In the invention, a printing plate precursor having a hydrophilic layer having effective protrusions of from 500 to less than 3000 per $mm^2$ can provide both good printability and high printing durability. Particularly, a printing plate precursor having an image formation layer on the hydrophilic layer increases an image protection effect, resulting in high printing durability.

In the invention, the hydrophilic layer has a center line average roughness Ra of preferably from 200 nm to 700 nm, and more preferably from 300 to 600 nm. The protrusions are preferably from 700 to less than 2000 per $mm^2$.

A printing plate precursor comprising effective protrusions of less than 500 per $mm^2$ may require many printed matter to remove ink staining at the background produced due to change of printing conditions, resulting in lowering of the image protection and printing durability. In contrast, a printing plate precursor comprising effective protrusions of more than 3000 per $mm^2$ lowers resolution of a formed image due to too many protrusions, and further, as printing proceeds, the verteces of the protrusions at image portions are markedly abraded, and a density at the solid image decreases, resulting in lowering of printing durability.

In the invention, the surface of the hydrophilic layer has a skewness Rsk preferably exceeding 2. The term skewness Rsk implies a measure of showing a degree of deviation from the Gaussian distribution of a height distribution in a rough surface. When the surface is comprised of concave portions, the skewness shows a negative value, and when the surface is comprised of convex portions, the skewness shows a positive value. In the invention, the skewness of the surface of the hydrophilic layer shows a positive value, and a printing plate precursor having a hydrophilic layer with a skewness exceeding 2 provides further excellent image protection effect, and further improved printing durability.

It is preferred that the hydrophilic layer in the printing plate precursor of the invention has the surface shape parameters described above, and further contains a hydrophilic matrix phase and inorganic particles or particles coated with an inorganic material each particle having a particle size of not less than 1 $\mu$m, and satisfies the above inequality (1).

The term "the hydrophilic matrix phase" herein referred to is a matrix phase comprised of an organic binder, an inorganic binder and another layer forming material, which is insoluble in water and hydrophilic. The hydrophilic layer may contain particles with a particle size of less than 1 $\mu$m, but the particles with a particle size of less than 1 $\mu$m are contained in the hydrophilic matrix phase.

Suitably adjusting the content or coating amount of components constituting the hydrophilic matrix phase and particles with a particle size of not less than 1 $\mu$m in the hydrophilic layer, the parameters falling within the range in the invention, which show the surface shapes in the invention, can be obtained, and the above inequality (1) can be satisfied.

In the printing plate precursor of the invention, an under layer is preferably provided between the hydrophilic layer and the substrate. In the printing plate precursor of the invention in which an under layer is preferably provided between the hydrophilic layer and the substrate, parameters showing the surface shape of the hydrophilic layer can be adjusted adding particles with a size of not less than 1 $\mu$m to the under layer. It is preferred that the printing plate precursor has an under layer containing a hydrophilic matrix phase and inorganic particles or inorganic material coated particles each particle having a particle size of not less than 1 $\mu$m, and a hydrophilic layer containing a hydrophilic matrix phase, wherein the above inequality (2) is satisfied.

Suitably adjusting the content or coating amount of components constituting the hydrophilic matrix phase and particles with a particle size of not less than 1 $\mu$m in the under layer, and the coating amount of the hydrophilic layer, the parameters falling within the range in the invention, which show the surface shapes in the invention, can be obtained, and the above inequality (2) can be satisfied.

In the printing plate precursor of the invention comprising an under layer and a hydrophilic layer, parameters showing the surface shape of the under layer and the hydrophilic layer can be adjusted adding particles with a size of not less than 1 $\mu$m to the under layer and the hydrophilic layer. It is preferred that the printing plate precursor comprises an under layer and a hydrophilic layer both containing a hydrophilic matrix phase and inorganic particles or inorganic material coated particles each having a particle size of not less than 1 $\mu$m, wherein the above inequalities (1) and (2) are satisfied. A hydrophilic layer having a multilayer roughness structure can be formed adding particles with a particle size of not less than 1 $\mu$m to the under layer and the hydrophilic layer, and adjusting a particle distribution in each layer.

Suitably adjusting the content or coating amount of components constituting the hydrophilic matrix phase and particles with a particle size of not less than 1 $\mu$m in the under layer, and the content or coating amount of components constituting the hydrophilic matrix phase and particles with a particle size of not less than 1 $\mu$m in the hydrophilic layer, the parameters falling within the range in the invention, which show the surface shapes in the invention, can be obtained, and the above inequality (2) can be satisfied.

As a preferred embodiment of the hydrophilic layer in the invention, the hydrophilic matrix phase of the hydrophilic layer has a regular convexoconcave structure. Unlike one formed by the particles described above, it is preferred that the regular convexoconcave structure has a minute convexoconcave pitch and a gentle slope. The hydrophilic layer has a convexoconcave pitch of preferably from 0.1 to 20 $\mu$m, and more preferably from 0.5 to 10 $\mu$m.

Such a regular convexoconcave structure is obtained by a hydrophilic layer containing particles having a particle size of not less than 1 $\mu$m, or by phase separation of the hydrophilic layer during drying after coating as described later.

Overlapping of such a minute convexoconcave structure can form a complex and multiple structure, and greatly improve printing performance.

It is preferred in the invention that the hydrophilic layer of the printing plate precursor has a porous structure. The optimum porosity increases a surface area of the hydrophilic layer, and increases hydrophilicity and water retention ability. The hydrophilic layer having such an optimum porosity can increase strength of formed images due to their firm adhesion to the layer when it is used in combination with an image formation method described later.

In the invention, the porous hydrophilic layer can be formed adding porosity providing agents to the hydrophilic layer.

In the invention, degree of porosity of the porous hydrophilic layer is preferably from 5 to 70%, and more preferably from 10 to 50%, in terms of void content. The void content of less than 5% provides poor printability and image strength, and the void content exceeding 70% lowers strength of the hydrophilic layer, resulting in lowering of printing durability, which is undesirable.

As one of embodiments of the printing plate precursor of the invention, there is a printing plate precursor comprising an under layer or a hydrophilic layer, and further comprising an image formation layer capable of forming an image by heat application on the substrate, wherein at least one of the layers provided on the substrate contains a light heat conversion material. This printing plate precursor is suitable to record an image by infrared laser on it.

The above embodiments include an ablation type printing plate precursor in which an oleophilic ablation layer containing a light heat conversion material is provided closer to the substrate than the hydrophilic layer. Even the ablation type printing plate precursor, comprising the hydrophilic layer having the surface shape as defined by the invention, can provide excellent printability and printing durability.

As one of embodiments of the printing plate precursor of the invention in use of an infrared laser recording, there is a printing plate precursor comprising an image formation layer capable of forming an image on the hydrophilic layer, wherein the image formation layer contains heat fusion particles or heat melting particles. In this embodiment, it is possible to add a light heat conversion material to the hydrophilic layer and/or the image formation layer, but when the light heat conversion material is colored, it is preferred that the light heat conversion material is added to the hydrophilic layer or to the hydrophilic layer and/or the under layer. This is because, when printing is carried out employing a printing plate obtained by removing, on press, the image formation layer at unexposed portions with dampening water or ink, color contamination may occur in printed matter.

In this embodiment, the image formation layer contains heat melting particles or heat fusion particles each including an image formation material. The particles in the hydrophilic layer at unexposed portions are easily removed from the hydrophilic layer, but those at exposed portions, being melted and adhered to each other to be fixed on the hydrophilic layer, are removed with difficulty and function as images. Particularly in a combination of heat melting particles, providing a low melt viscosity, and a porous hydrophilic layer, the image formation materials melted at exposed portions permeate into the porous hydrophilic layer, and forms an image with high fastness there.

The coating amount of the image formation layer is preferably from 0.1 to 5 $g/m^2$, more preferably from 0.2 to 2 $g/m^2$, and still more preferably from 0.3 to 1.0 $g/m^2$.

In this embodiment, the image formation layer is protected at both unexposed and exposed portions by effective protrusions formed in the hydrophilic layer or the under layer. It is preferred that the image formation layer is in the form in which external force is applied with difficulty, and most of the surface of the image formation layer are provided closer to the substrate than the vertices of the protrusions. This provides the effect of restraining phenomenon that heat melting particles or heat fusion particles are pressed or rubbed to be fixed on the hydrophilic layer during handling of the printing plate precursor before printing, resulting in occurrence of staining in printing. Further, it prevents the image portions from contacting a dampening water roller, an ink roller, or a blanket cylinder, and greatly increases printing durability.

The printing plate of the invention is one prepared by imagewise providing an image formation material on the hydrophilic layer of the printing plate precursor of the invention to form an image. The image formation can be carried out by transfer of an image formation material melted by irradiation of infrared ray as described above, but is carried out preferably by an ink jet process. In this case, the hydrophilic layer is preferably porous in that ink properly permeates into the porous hydrophilic layer to be firmly fixed on the hydrophilic layer.

Provision of ink containing an image formation material by an ink jet process can be carried out employing well-known methods. As the image formation material-containing ink, various well-known inks can be used, but radiation hardenable ink described later is preferably used. When the radiation hardenable ink is used as the image formation material, immediately after the ink is provided on the hydrophilic layer, the resulting hydrophilic layer is preferably irradiated with light including a wavelength capable of hardening the ink.

Next, the main elements constituting the printing plate precursor of the invention, an image formation method, radiation hardenable ink, and an ink jet recording process will be explained.

<<Hydrophilic Layer>>

Materials used in the hydrophilic layer of the printing plate precursor of the invention include the following.

(Material for Forming a Hydrophilic Matrix Phase in the Hydrophilic Layer)

Material for forming a hydrophilic matrix phase in the hydrophilic layer is preferably a metal oxide. The metal oxide preferably comprises metal oxide particles. Examples of the metal oxide particles include a colloidal silica, an alumina sol, a titania sol and another metal oxide sol. The metal oxide particles may have any shape such as spherical, needle-like, and feather-like shape. The average particle size is preferably from 3 to 100 nm, and plural kinds of metal oxide each having a different size may be used in combination. The surface of the particles may be subjected to surface treatment.

The metal oxide particles can be used as a binder, utilizing its layer forming ability. The metal oxide particles are suitably used in a hydrophilic layer since they minimize lowering of the hydrophilicity of the layer as compared with an organic compound binder.

Among the above-mentioned, colloidal silica is particularly preferred. The colloidal silica has a high layer forming ability under a drying condition with a relative low temperature, and can provide a good layer strength. It is preferred that the colloidal silica used in the invention is necklace-shaped colloidal silica or colloidal silica particles having an average particle size of not more than 20 nm, each being described later. Further, it is preferred that the colloidal silica provides an alkaline colloidal silica solution as a colloid solution.

The necklace-shaped colloidal silica to be used in the invention is a generic term of an aqueous dispersion system of a spherical silica having a primary particle size of the order of nm. The necklace-shaped colloidal silica to be used in the invention means a "pearl necklace-shaped" colloidal silica formed by connecting spherical colloidal silica particles each having a primary particle size of from 10 to 50 $\mu$m so as to attain a length of from 50 to 400 nm. The term of "pearl necklace-shaped" means that the image of connected colloidal silica particles is like to the shape of a pearl necklace. The bonding between the silica particles forming the necklace-shaped colloidal silica is considered to be —Si—O—Si—, which is formed by dehydration of —SiOH groups located on the surface of the silica particles. Concrete examples of the necklace-shaped colloidal silica include Snowtex-PS series produced by Nissan Kagaku Kogyo, Co., Ltd. As the products, there are Snowtex-PS-S (the average particle size in the connected state is approximately 110 nm), Snowtex-PS-M (the average particle size in the connected state is approximately 120 nm) and Snowtex-PS-L (the average particle size in the connected state is approximately 170 nm). Acidic colloidal silicas corresponding to each of the above-mentioned are Snowtex-PS-S-O, Snowtex-PS-M-O and Snowtex-PS-L-O, respectively.

The necklace-shaped colloidal silica is preferably used in a hydrophilic layer as a porosity providing material for hydrophilic matrix phase, and porosity and strength of the layer can be secured by its addition to the layer. Among them, the use of Snowtex-PS-S, Snowtex-PS-M or Snowtex-PS-L, each being alkaline colloidal silica particles, is particularly preferable since the strength of the hydrophilic layer is increased and occurrence of background contamination is inhibited even when a lot of prints are printed.

It is known that the binding force of the colloidal silica particles becomes larger with a decrease of the particle size. The average particle size of the colloidal silica particles to be used in the invention is preferably not more than 20 nm, and more preferably 3 to 15 nm. As above-mentioned, the alkaline colloidal silica particles show the effect of inhibiting occurrence of the background contamination. Accordingly, the use of the alkaline colloidal silica particles is particularly preferable. Examples of the alkaline colloidal silica particles having the average particle size within the foregoing range include Snowtex-20 (average particle size: 10 to 20 nm), Snowtex-30 (average particle size: 10 to 20 nm), Snowtex-40 (average particle size: 10 to 20 nm), Snowtex-N (average particle size: 10 to 20 nm), Snowtex-S (average particle size: 8 to 11 nm) and Snowtex-XS (average particle size: 4 to 6 nm), each produced by Nissan Kagaku Co., Ltd.

The colloidal silica particles having an average particle size of not more than 20 nm, when used together with the necklace-shaped colloidal silica as described above, is particularly preferred, since porosity of the layer is maintained and the layer strength is further increased.

The ratio of the colloidal silica particles having an average particle size of not more than 20 nm to the necklace-shaped colloidal silica is preferably from 95/5 to 5/95, more preferably from 70/30 to 20/80, and most preferably from 60/40 to 30/70.

The hydrophilic layer of the printing plate precursor of the invention contains porous metal oxide particles as metal oxides. Examples of the porous metal oxide particles include porous silica particles, porous aluminosilicate particles or zeolite particles as described later.

<Porous Silica or Porous Aluminosilicate Particles>

The porous silica particles are ordinarily produced by a wet method or a dry method. By the wet method, the porous silica particles can be obtained by drying and pulverizing a gel prepared by neutralizing an aqueous silicate solution, or pulverizing the precipitate formed by neutralization. By the dry method, the porous silica particles are prepared by combustion of silicon tetrachloride together with hydrogen and oxygen to precipitate silica. The porosity and the particle size of such particles can be controlled by variation of the production conditions. The porous silica particles prepared from the gel by the wet method is particularly preferred.

The porous aluminosilicate particles can be prepared by the method described in, for example, JP O.P.I. No. 10-71764. Thus prepared aluminosilicate particles are amorphous complex particles synthesized by hydrolysis of aluminum alkoxide and silicon alkoxide as the major components. The particles can be synthesized so that the ratio of alumina to silica in the particles is within the range of from 1:4 to 4:1. Complex particles composed of three or more components prepared by an addition of another metal alkoxide may also be used in the invention. In such a particle, the porosity and the particle size can be controlled by adjustment of the production conditions.

The porosity of the particles is preferably not less than 1.0 ml/g, more preferably not less than 1.2 ml/g, and most preferably of from 1.8 to 2.5 ml/g, in terms of pore volume before the dispersion. The pore volume is closely related to water retention of the coated layer. As the pore volume increases, the water retention is increased, contamination is difficult to occur, and the water retention latitude is broad. Particles having a pore volume of more than 2.5 ml/g are brittle, resulting in lowering of durability of the layer containing them. Particles having a pore volume of less than 0.5 ml/g may be insufficient in printing performance.

<Zeolite Particles>

Zeolite is a crystalline aluminosilicate, which is a porous material having voids of a regular three dimensional net work structure and having a pore size of 0.3 to 1 nm. Natural and synthetic zeolites are expressed by the following formula.

$$(M_1.(M_2)_{0.5})_m(Al_mSi_nO_{2(m+n)}).xH_2O$$

In the above, $M_1$ and $M_2$ are each exchangeable cations. Examples of $M_1$ or $M_2$ include $Li^+$, $Na^+$, $K^+$, $Tl^+$, $Me_4N^+$ (TMA), $Et_4N^+$ (TEA), $Pr_4N^+$ (TPA), $C_7H_{15}N^{2+}$, and $C_8H_{16}N^+$, and examples of $M^2$ include $Ca^{2+}$, $Mg^{2+}$, $Ba^{2+}$, $Sr^{2+}$ and $(C_8H_{18}N)_2^{2+}$. Relation of n and m is $n \geqq m$, and consequently, the ratio of m/n, or that of Al/Si is not more than 1. A higher Al/Si ratio shows a higher content of the exchangeable cation, and a higher polarity, resulting in higher hydrophilicity. The Al/Si ratio is within the range of preferably from 0.4 to 1.0, and more preferably 0.8 to 1.0. x is an integer.

Synthetic zeolite having a stable Al/Si ratio and a sharp particle size distribution is preferably used as the zeolite particles to be used in the invention. Examples of such zeolite include Zeolite A: $Na_{12}(Al_{12}Si_{12}O_{48}).27H_2O$; Al/Si=1.0, Zeolite X: $Na_{86}(Al_{86}Si_{106}O_{384}).264H_2O$; Al/Si=0.811, and Zeolite Y: $Na_{56}(Al_{56}Si_{136}O_{384}).250H_2O$; Al/Si =0.412.

Containing the porous zeolite particles having an Al/Si ratio within the range of from 0.4 to 1.0 in the hydrophilic layer greatly raises the hydrophilicity of the hydrophilic layer itself, whereby contamination in the course of printing is inhibited and the water retention latitude is also increased. Further, contamination caused by a finger mark is also greatly reduced. When Al/Si is less than 0.4, the hydrophilicity is insufficient and the above-mentioned improving effects are lowered.

The hydrophilic matrix phase of the printing plate precursor of the invention can contain layer structural clay mineral particles as a metal oxide. Examples of the layer structural clay mineral particles include a clay mineral such as kaolinite, halloysite, talk, smectite such as montmorillonite, beidellite, hectorite and saponite, vermiculite, mica and chlorite; hydrotalcite; and a layer structural polysilicate such as kanemite, makatite, ilerite, magadiite and kenyte. Among them, ones having a higher electric charge density of the unit layer are higher in the polarity and in the hydrophilicity. Preferable charge density is not less than 0.25, more preferably not less than 0.6. Examples of the layer structural mineral particles having such a charge density include smectite having a negative charge density of from 0.25 to 0.6 and bermiculite having a negative charge density of from 0.6 to 0.9. Synthesized fluorinated mica is preferable since one having a stable quality, such as the particle size, is available. Among the synthesized fluorinated mica, swellable one is preferable and one freely swellable is more preferable.

An intercalation compound of the foregoing layer structural mineral particles such as a pillared crystal, or one treated by an ion exchange treatment or a surface treatment such as a silane coupling treatment or a complication treatment with an organic binder is also usable.

With respect to the size of the planar structural mineral particles, the particles have an average particle size (an average of the largest particle length) of preferably not more than 20 μm, and more preferably not more than 10 μm, and an average aspect ratio (the largest particle length/the particle thickness of preferably not less than 20, and more preferably not less than 50, in a state contained in the layer including the case that the particles are subjected to a swelling process and a dispersing layer-separation process. When the particle size is within the foregoing range, continuity to the parallel direction, which is a trait of the layer structural particle, and softness, are given to the coated layer so that a strong dry layer in which a crack is difficult to be formed can be obtained. The coating solution containing the layer structural clay mineral particles in a large amount can minimize particle sedimentation due to a viscosity increasing effect. The particle size greater than the foregoing may produce a non-uniform coated layer, resulting in poor layer strength. The aspect ratio lower than the foregoing reduces the planar particles, resulting in insufficient viscosity increase and reduction of particle sedimentation inhibiting effect.

The content of the layer structural clay mineral particles is preferably from 0.1 to 30% by weight, and more preferably from 1 to 10% by weight based on the total weight of the layer. Particularly, the addition of the swellable synthesized fluorinated mica or smectite is effective if the adding amount is small. The layer structural clay mineral particles may be added in the form of powder to a coating liquid, but it is preferred that gel of the particles which is obtained by being swelled in water, is added to the coating liquid in order to obtain a good dispersity according to an easy coating liquid preparation method which requires no dispersion process comprising dispersion due to media.

An aqueous solution of a silicate is also usable as another additive to the hydrophilic matrix phase in the invention. An alkali metal silicate such as sodium silicate, potassium silicate or lithium silicate is preferable, and the $SiO_2/M_2O$ is preferably selected so that the pH value of the coating liquid after addition of the silicate exceeds 13 in order to prevent dissolution of the porous metal oxide particles or the colloidal silica particles.

An inorganic polymer or an inorganic-organic hybrid polymer prepared by a sol-gel method employing a metal alkoxide. Known methods described in S. Sakka "Application of Sol-Gel Method" or in the publications cited in the above publication can be applied to prepare the inorganic polymer or the inorganic-organic hybridpolymer by the sol-gel method.

In the invention, the hydrophilic matrix phase preferably contains a water soluble resin. Examples of the water soluble resin include polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylamide, and polyvinyl pyrrolidone. In the invention, polysaccharides are preferably used as the water soluble resin.

As the polysaccharide, starches, celluloses, polyuronic acid and pullulan can be used. Among them, a cellulose derivative such as a methyl cellulose salt, a carboxymethyl cellulose salt or a hydroxyethyl cellulose salt is preferable, and a sodium or ammonium salt of carboxymethyl cellulose is more preferable. These polysaccharides can form a preferred surface shape of the hydrophilic layer.

The surface of the hydrophilic layer preferably has a convexoconcave structure having a pitch of from 0.1 to 50 μm such as the grained aluminum surface of an aluminum PS plate. The water retention ability and the image maintaining ability are raised by such a convexoconcave structure of the surface. Such a convexoconcave structure can also be formed by adding in an appropriate amount a filler having a suitable particle size to the coating liquid of the hydrophilic layer. However, the convexoconcave structure is preferably formed by coating a coating liquid for the hydrophilic layer containing the alkaline colloidal silica and the water-soluble polysaccharide so that the phase separation occurs at the time of drying the coated liquid, whereby a structure is obtained which provides a good printing performance.

The shape of the convexoconcave structure such as the pitch and the surface roughness thereof can be suitably controlled by the kinds and the adding amount of the alkaline colloidal silica particles, the kinds and the adding amount of the water-soluble polysaccharide, the kinds and the adding amount of another additive, a solid concentration of the coating liquid, a wet layer thickness or a drying condition.

In the invention, it is preferred that the water soluble resin contained in the hydrophilic matrix phase is water soluble, and at least a part of the resin exists in the hydrophilic layer in a state capable of being dissolved in water. If a water soluble carbon atom-containing material is cross-linked by a crosslinking agent and is insoluble in water, its hydrophilicity is lowered, resulting in problem of lowering printing performance. A cationic resin may also be contained in the hydrophilic layer. Examples of the cationic resin include a polyalkylene-polyamine such as a polyethyleneamine or polypropylenepolyamine or its derivative, an acryl resin having a tertiary amino group or a quaternary ammonium group and diacrylamine. The cationic resin may be added in a form of fine particles. Examples of such particles include the cationic microgel described in Japanese Patent O.P.I. Publication No. 6-161101.

A water-soluble surfactant may be added for improving the coating ability of the coating liquid for the hydrophilic layer in the invention. A silicon atom-containing surfactant and a fluorine atom-containing surfactant are preferably used. The silicon atom-containing surfactant is especially preferred in that it minimizes printing contamination. The content of the surfactant is preferably from 0.01 to 3% by weight, and more preferably from 0.03 to 1% by weight based on the total weight of the hydrophilic layer (or the solid content of the coating liquid).

The hydrophilic layer in the invention can contain a phosphate. Since a coating liquid for the hydrophilic layer is preferably alkaline, the phosphate to be added to the hydrophilic layer is preferably sodium phosphate or sodium monohydrogen phosphate. The addition of the phosphate provides improved reproduction of dots at shadow portions. The content of the phosphate is preferably from 0.1 to 5% by weight, and more preferably from 0.5 to 2% by weight in terms of amount excluding hydrated water.

The hydrophilic layer in the invention can contain a light heat conversion material as described later. When the material is in the particle form, the particle size is preferably less than 1 μm.

<Inorganic Particles or Inorganic Material Coated Particles Both Having a Particle Size not Less than 1 μm (Hereinafter Referred to Also as Particles in the Invention)>

Examples of the inorganic particles include well-known metal oxide particles include particles of silica, alumina, titania and zirconia. Porous metal oxide particles are preferably used in order to prevent sedimentation of the particles in a coating liquid. Examples of the porous metal oxide particles include the porous silica particles and the porous aluminosilicate particles described above.

The inorganic material coated particles include particles in which organic particles such as polymethyl methacrylate particles or polystyrene particles form cores and the cores are covered with inorganic particles having a size smaller than that of the cores. The particle size of the inorganic particles is preferably from 1/10 to 1/100 of that of the cores. Further, well-known metal oxide particles include particles of silica, alumina, titania and zirconia can be used as the inorganic particles. There are various covering methods, but a dry covering method is preferred in which the cores collide with the covering materials at high speed in air as in a hybridizer for the covering materials to penetrate the surface of the cores and fix them there.

Particles in which organic particles are plated with a metal can be used. Examples of such particles include Micropearl AU produced by Sekisui Kagaku Co., Ltd., in which resin particles are plated with a metal.

It is preferred that the particles in the invention have a particle size of not less than 1 μm, and satisfy inequality (1) described previously. The particle size is more preferably from 1 to 10 μm, still more preferably from 1.5 to 8 μm, and most preferably from 2 to 6 μm.

When the particle size exceeds 10 μm, it may lower dissolution of formed images or result in contamination of blanket during printing. In the invention, the content of the particles having a particle size of not less than 1 μm in the hydrophilic layer is suitably adjusted to satisfy the parameters regarding the invention, but is preferably from 1 to 50% by weight, and more preferably from 5 to 40% by weight, based on the hydrophilic layer. The content of materials containing a carbon atom such as the organic resins or carbon black in the hydrophilic layer is preferably lower in increasing hydrophilicity of the hydrophilic layer. The total content of these materials in the hydrophilic layer is preferably less than 9% by weight, and more preferably less than 5% by weight.

<<Under Layer>>

In the invention, when an under layer is provided, materials used in the under layer include the same materials as in the hydrophilic layer described previously. The under layer, which is porous, is less advantageous. The under layer is preferably non-porous. The porosity providing agent content of the under layer is preferably lower than that of the hydrophilic layer in view of strength of the under layer. It is more preferable that the under layer contains no porosity providing agent.

The content of the particles having a particle size of not less than 1 μm in the under layer is suitably adjusted to satisfy the parameters regarding the invention, but is preferably from 1 to 50% by weight, and more preferably from 5 to 40% by weight, based on the under layer.

Like the hydrophilic layer, the content of materials containing a carbon atom such as the organic resins or carbon black in the under layer is preferably lower in increasing hydrophilicity of the under layer. The total content of these materials in the under layer is preferably less than 9% by weight, and more preferably less than 5% by weight.

<<Light Heat Conversion Material>>

The hydrophilic layer, an under layer or another layer in the invention can contain a light heat conversion material as described later.

Examples of the light heat conversion material include the following substances:

(Infrared Absorbing Dye)

Examples of the light-heat conversion material include a general infrared absorbing dye such as a cyanine dye, a chloconium dye, a polymethine dye, an azulenium dye, a squalenium dye, a thiopyrylium dye, a naphthoquinone dye or an anthraquinone dye, and an organometallic complex such as a phthalocyanine compound, a naphthalocyanine compound, an azo compound, a thioamide compound, a dithiol compound or an indoaniline compound. Exemplarily, the light-heat conversion materials include compounds disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds may be used singly or in combination.

(Pigment)

Examples of pigment include carbon, graphite, a metal and a metal oxide. Furnace black and acetylene black is preferably used as the carbon. The graininess ($d_{50}$) thereof is preferably not more than 100 nm, and more preferably not more than 50 nm.

(Graphite)

The graphite is one having a particle size of preferably not more than 0.5 μm, more preferably not more than 100 nm, and most preferably not more than 50 nm.

(Metal)

As the metal, any metal can be used as long as the metal is in a form of fine particles having preferably a particle size of not more than 0.5 μm, more preferably not more than 100 nm, and most preferably not more than 50 nm. The metal may have any shape such as spherical, flaky and needle-like. Colloidal metal particles such as those of silver or gold are particularly preferred.

(Metal Oxide)

As the metal oxide, materials having black color in the visible regions or materials which are electro-conductive or semi-conductive can be used. Examples of the former include black iron oxide ($Fe_3O_4$), and black complex metal oxides containing at least two metals. Examples of the latter include Sb-doped $SnO_2$ (ATO), Sn-added $In_2O_3$ (ITO), $TiO_2$, TiO prepared by reducing $TiO_2$ (titanium oxide nitride, generally titanium black). Particles prepared by covering a core material such as $BaSO_4$, $TiO_2$, $9Al_2O_3.2B_2O$ and $K_2O.nTiO_2$ with these metal oxides is usable. The particle size of these particles is preferably not more than 0.5 μm, more preferably not more than 100 nm, and most preferably not more than 50 nm.

Among these light heat conversion materials, black complex metal oxides containing at least two metals are preferred. Typically, the black complex metal oxides include complex metal oxides comprising at least two selected from Al, Ti, Cr, Mn, Fe, Co, Ni, Cu, Zn, Sb, and Ba. These can be prepared according to the methods disclosed in Japanese Patent O.P.I. Publication Nos. 9-27393, 9-25126, 9-237570, 9-241529 and 10-231441.

The complex metal oxide used in the invention is preferably a complex Cu—Cr—Mn type metal oxide or a Cu—Fe—Mn type metal oxide. The Cu—Cr—Mn type metal oxides are preferably subjected to the treatment disclosed in Japanese Patent O.P.I. Publication Nos. 8-27393 in order to reduce isolation of a 6-valent chromium ion. These complex metal oxides have a high color density and a high light heat conversion efficiency as compared with another metal oxide.

The primary average particle size of these complex metal oxides is preferably from 0.001 to 1.0 μm, and more preferably from 0.01 to 0.5 μm. The primary average particle size of from 0.001 to 1.0 μm improves a light heat conversion efficiency relative to the addition amount of the particles, and the primary average particle size of from 0.05 to 0.5 μm further improves a light heat conversion efficiency relative to the addition amount of the particles. The light heat conversion efficiency relative to the addition amount of the particles depends on a dispersity of the particles, and the well-dispersed particles have a high light heat conversion efficiency. Accordingly, these complex metal oxide particles are preferably dispersed according to a known dispersing method, separately to a dispersion liquid (paste), before being added to a coating liquid for the particle containing layer. The metal oxides having a primary average particle size of less than 0.001 are not preferred since they are difficult to disperse. A dispersant is optionally used for dispersion. The addition amount of the dispersant is preferably from 0.01 to 5% by weight, and more preferably from 0.1 to 2% by weight, based on the weight of the complex metal oxide particles.

The addition amount of the complex metal oxide is preferably 0.1 to 50% by weight, more preferably 1 to 30% by weight, and most preferably 3 to 25% by weight based on the weight of hydrophilic layer or under layer.

<<Image Formation Layer>>

In the invention, the image formation layer containing heat melting particles and/or heat fusible particles can contain materials described below.

(Heat Melting Particles)

The heat melting particles used in the invention are particularly particles having a low melt viscosity, or particles formed from materials generally classified into wax. The materials preferably have a softening point of from 40° C. to 120° C. and a melting point of from 60° C. to 150° C., and more preferably a softening point of from 40° C. to 100° C. and a melting point of from 60° C. to 120° C. The melting point less than 60° C. has a problem in storage stability and the melting point exceeding 300° C. lowers ink receptive sensitivity.

Materials usable include paraffin, polyolefin, polyethylene wax, microcrystalline wax, and fatty acid wax. The molecular weight thereof is approximately from 800 to 10,000. A polar group such as a hydroxyl group, an ester group, a carboxyl group, an aldehyde group and a peroxide group may be introduced into the wax by oxidation to increase the emulsification ability. Moreover, stearoamide, linolenamide, laurylamide, myristylamide, hardened cattle fatty acid amide, parmitylamide, oleylamide, rice bran oil fatty acid amide, palm oil fatty acid amide, a methylol compound of the above-mentioned amide compounds, methylenebissteastearoamide and ethylenebissteastearoamide may be added to the wax to lower the softening point or to raise the working efficiency. A cumarone-indene resin, a rosin-modified phenol resin, a terpene-modified phenol resin, a xylene resin, a ketone resin, an acryl resin, an ionomer and a copolymer of these resins may also be usable.

Among them, polyethylene, microcrystalline wax, fatty acid ester and fatty acid are preferably contained. A high sensitive image formation can be performed since these materials each have a relative low melting point and a low melt viscosity. These materials each have a lubrication ability. Accordingly, even when a shearing force is applied to the surface layer of the printing plate precursor, the layer damage is minimized, and resistance to contaminations which may be caused by scratch is further enhanced.

The heat melting particles are preferably dispersible in water. The average particle size thereof is preferably from 0.01 to 10 μm, and more preferably from 0.1 to 3 μm. When a layer containing the heat melting particles is coated on the porous hydrophilic layer, the particles having an average particle size less than 0.01 μm may enter the pores of the hydrophilic layer or the valleys between the neighboring two peaks on the hydrophilic layer surface, resulting in insufficient on press development and background contaminations. The particles having an average particle size exceeding 10 μm may result in lowering of dissolving power.

The composition of the heat melting particles may be continuously varied from the interior to the surface of the particles. The particles may be covered with a different material. Known microcapsule production method or sol-gel method can be applied for covering the particles. The heat melting particle content of the layer is preferably 1 to 90% by weight, and more preferably 5 to 80% by weight based on the total layer weight.

(Heat Fusible Particles)

The heat fusible particles in the invention include thermoplastic hydrophobic polymer particles. Although there is no specific limitation to the upper limit of the softening point of the thermoplastic hydrophobic polymer particles, the softening point is preferably lower than the decomposition temperature of the polymer particles. The weight average molecular weight (Mw) of the polymer is preferably within the range of from 10,000 to 1,000,000.

Examples of the polymer consisting the polymer particles include a diene (co)polymer such as polypropylene, polybutadiene, polyisoprene or an ethylene-butadiene copolymer; a synthetic rubber such as a styrene-butadiene copolymer, a methyl methacrylate-butadiene copolymer or an acrylonitrile-butadiene copolymer; a (meth)acrylate (co) polymer or a (meth)acrylic acid (co)polymer such as polymethyl methacrylate, a methyl methacrylate-(2-ethylhexyl) acrylate copolymer, a methyl methacrylate-methacrylic acid copolymer, or a methylacrylate-(N-methylolacrylamide); polyacrylonitrile; a vinyl ester (co)polymer such as a polyvinyl acetate, a vinyl acetate-vinyl propionate copolymer and a vinyl acetate-ethylene copolymer, or a vinyl acetate-2-hexylethyl acrylate copolymer; and polyvinyl chloride, polyvinylidene chloride, polystyrene and a copolymer thereof. Among them, the (meth)acrylate polymer, the (meth)acrylic acid (co)polymer, the vinyl ester (co)polymer, the polystyrene and the synthetic rubbers are preferably used.

The polymer particles may be prepared from a polymer synthesized by any known method such as an emulsion polymerization method, a suspension polymerization method, a solution polymerization method and a gas phase polymerization method. The particles of the polymer synthesized by the solution polymerization method or the gas phase polymerization method can be produced by a method in which an organic solution of the polymer is sprayed into an inactive gas and dried, and a method in which the polymer is dissolved in a water-immiscible solvent, then the resulting solution is dispersed in water or an aqueous medium and the solvent is removed by distillation. In both of the methods, a surfactant such as sodium lauryl sulfate, sodium dodecylbenzenesulfate or polyethylene glycol, or a water-soluble resin such as poly(vinyl alcohol) may be optionally used as a dispersing agent or stabilizing agent.

The heat fusible particles are preferably dispersible in water. The average particle size of the heat fusible particles is preferably from 0.01 to 10 μm, and more preferably from 0.1 to 3 μm. When a layer containing the heat fusible particles having an average particle size less than 0.01 μm is coated on the porous hydrophilic layer, the particles may enter the pores of the hydrophilic layer or the valleys between the neighboring two peaks on the hydrophilic layer surface, resulting in insufficient on press development and background contaminations. The heat fusible particles having an average particle size exceeding 10 μm may result in lowering of dissolving power.

Further, the composition of the heat fusible particles may be continuously varied from the interior to the surface of the particles. The particles may be covered with a different material. As a covering method, known methods such as a microcapsule method and a sol-gel method are usable. The heat fusible particle content of the layer is preferably from 1 to 90% by weight, and more preferably from 5 to 80% by weight based on the total weight of the layer.

(Water Soluble Material)

In the invention, the image formation layer containing heat fusible particles or heat melting particles can further contain a water soluble material. When an image formation layer at unexposed portions is removed on a press with dampening water or ink, the water soluble material makes it possible to easily remove the layer.

Regarding the water soluble material, those described above as water soluble materials to be contained in the hydrophilic layer can be used. The image formation layer in the invention preferably contains saccharides, and more preferably contains oligosaccharides. Since the oligosaccharides are easily dissolved in water, removal on a press of unexposed portions of an oligosaccharide-containing layer can be easily carried out dissolving the saccharide in water. The removal does not require a specific system, and can be carried out conducting the same manner as in the beginning of printing of a conventional PS plate, which does not increase loss of prints at the beginning of printing. Use of the oligosaccharide does not lower hydrophilicity of the hydrophilic layer and can maintain good printing performance of the hydrophilic layer. The oligosaccharide is a water-soluble crystalline substance generally having a sweet taste, which is formed by a dehydration condensation reaction of plural monosaccharide molecules. The oligosaccharide is one kind of o-glycoside having a saccharide as the aglycon. The oligosaccharide is easily hydrolyzed by an acid to form a monosaccharide, and is classified according to the number of monosaccharide molecules of the resulting hydrolysis compounds, for example, into disaccharide, trisaccharide, tetrasaccharide, and pentasscharide. The oligosaccharide referred to in the invention means di- to deca-saccharides.

The oligosaccharide is classified into a reducing oligosaccharide and a non-reducing oligosaccharide according to presence or absence of a reducing group in the molecule. The oligosaccharide is also classified into a homo-oligosaccharide composed of the same kind of monosaccharide and a hetero-oligosaccharide composed of two or more kinds of monosaccharides. The oligosaccharide naturally exists in a free state or a glycoside state. Moreover, various oligosaccharides are formed by glycosyl transition by action of an enzyme.

The oligosaccharide frequently exists in a hydrated state in an ordinary atmosphere. The melting points of the hydrated one and anhydrous one are different from each other as shown in the following Table 1.

TABLE 1

| Kinds of oligosaccharide | | Melting point (° C.) Hydrates | Anhydrides |
|---|---|---|---|
| Raffinose | Trisaccharide | 80 (Pentahydrate) | 118 |
| Trehalose | Disaccharide | 97 (Dihydrate) | 215 |
| Maltose | Disaccharide | 103 (Monohydrate) | 108 |
| Galactose | Disaccharide | 119 (Monohydrate) | 167 |
| Sucrose | Disaccharide | None | 182 |
| Lactose | Disaccharide | 201 (Monohydrate) | 252 |

In the invention, the layer containing a saccharide is preferably formed coating an aqueous coating solution containing the saccharide on a support. When an oligosaccharide in the layer formed from the aqueous coating solution is one capable of forming a hydrate, the melting point of the oligosaccharide is that of its hydrate. Since the oligosaccharides, having a relatively low melting point, also melt within the temperature range at which heat melting particles melt or heat fusible particles fuse, they do not cause image formation inhibition resulting from permeation of the heat melting particles into the porous hydrophilic layer and/or fusion adhesion of the heat fusible particles to the hydrophilic layer.

Among the oligosaccharides, trehalose with comparatively high purity is available on the market, and has an extremely low hygroscopicity, although it has high water solubility, providing excellent storage stability and excellent development property on a printing press.

When oligosaccharide hydrates are heat melted to remove the hydrate water and solidified, the oligosaccharide is in a form of anhydride for a short period after solidification. Trehalose is characterized in that a melting point of trehalose anhydride is not less than 100° C. higher that that of trehalose hydrate. This characteristic provides a high melting point and reduced heat fusibility at exposed portions of the trehalose-containing layer immediately after heat-fused by infrared ray exposure and re-solidified, preventing image defects at exposure such as banding from occurring. In order to attain the object of the invention, trehalose is preferable among oligosaccharides. The oligosaccharide content of the layer is preferably from 1 to 90% by weight, and more preferably from 10 to 80% by weight, based on the total weight of the layer.

<<Image Formation According to Infrared Ray>>

Image formation on the printing plate precursor of the invention is carried out by applying heat and preferably by infrared ray exposure.

Exposure applied in the invention is preferably scanning exposure, which is carried out employing a laser which can emit light having a wavelength of infrared and/or near-infrared regions, that is, a wavelength of from 700 to 1500 nm. As the laser, a gas laser can be used, but a semi-conductor laser, which emits light having a near-infrared region wavelength, is preferably used.

A device suitable for the scanning exposure in the invention may be any device capable of forming an image on the printing plate precursor according to image signals from a computer employing a semi-conductor laser.

Generally, the following scanning exposure processes are mentioned.

(1) A process in which a plate precursor provided on a fixed horizontal plate is scanning exposed in two dimensions, employing one or several laser beams.

(2) A process in which the surface of a plate precursor provided along the inner peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

(3) A process in which the surface of a plate precursor provided along the outer peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

In the invention, the process (3) above is preferable, and especially preferable when a printing plate precursor mounted on a plate cylinder of a printing press is scanning exposed.

<<Method Imagewise Providing Lipophilic Material>>

In the printing plate precursor of the invention, an image can be formed by imagewise providing a lipophilic material directly on the surface of the hydrophilic layer.

As one of the methods of imagewise providing the lipophilic material, there is a method of employing a known thermal transfer process. For example, there is a method of imagewise transferring a heat fusible ink of an ink ribbon having a heat fusible ink layer onto the surface of the hydrophilic layer employing a thermal head.

There is also a method of mounting the printing plate precursor on an exposure drum of a digital proof apparatus employing an infrared laser heat fusion transfer process, with the hydrophilic layer outwardly, further providing an ink sheet having an ink layer on the hydrophilic layer so that the ink layer contacts the hydrophilic layer, and then imagewise exposing the ink sheet by infrared laser to imagewise transfer a heat fusible ink of the ink layer onto the surface of the hydrophilic layer. In this case, a light heat conversion material may be contained in the hydrophilic layer of the printing plate precursor, in the ink sheet, or in both hydrophilic layer and ink sheet.

An image, which has been formed on the hydrophilic layer of the printing plate precursor employing a heat fusible ink, can be more firmly adhered to the hydrophilic layer by heating the printing plate precursor. When the hydrophilic layer contains a light heat conversion material, the heating can be carried out employing an infrared laser exposure or a flush exposure such as a xenon lamp exposure.

As another method of imagewise providing the lipophilic material, there is a method of employing a known ink jet process. In this case, inks used include a lipophilic ink disclosed in Japanese Patent Publication No. 2995075, a hot melt ink disclosed in Japanese Patent O.P.I. Publication No. 10-24550, a lipophilic ink, in which hydrophobic resin particles being a solid at ordinary temperature are dispersed, disclosed in Japanese Patent O.P.I. Publication No. 10-157053, and an aqueous ink, in which hydrophobic thermoplastic resin particles being a solid at ordinary temperature are dispersed. In the invention, a radiation hardenable ink is preferably used.

<<Radiation Curable Ink>>

The radiation curable ink in the invention contains at least a polymerizable compound, and can contain a colorant to produce a visible image.

As the colorant, a colorant such as a dye or pigment, which is soluble or dispersible in a main polymerizable compound, can be used. When pigment is used, dispersion treatment is carried out, since its degree of dispersion has a great influence on a color density. Devices for dispersing pigment include a ball mill, an atriter, a roll mill, an agitator, a Henschel mixer, a colloid mill, a supersonic homogenizer, a pearl mill, a wet jet mill, and a paint shaker. When pigment is dispersed, a dispersant can be added. As the dispersant, a polymer dispersant is preferably used, and preferred examples of the polymer dispersant include Solsperse series produced by Zeneca Co., Ltd. As an auxiliary dispersant, a synergist according to kinds of dispersant can be used. An addition amount of the dispersant or auxiliary dispersant is preferably from 1 to 50 parts by weight based on 100 parts by weight of pigment used. A dispersion medium is a solvent or a polymerizable compound. It is preferred that the radiation curable ink used in the invention does not contain a solvent, since it is hardened immediately after jetted to an image recording medium. The residual solvent in the hardened image results in lowering of solvent resistance and problem of VOC. The dispersion medium is preferably a polymerizable compound, and more preferably a monomer having the lowest viscosity among monomers.

Pigment, a dispersant, a dispersion medium, dispersing conditions and a filtration condition are determined to obtain pigment particles with an average particle size of preferably from 0.08 to 0.3 $\mu$m, a maximum particle size of from 0.3 to 10 $\mu$m, and preferably from 0.3 to 3 $\mu$m. The above range of the particle size can prevent clogging of an ink head nozzle, and provide excellent ink storage stability, ink transparency and ink curing sensitivity. The colorant content of ink is preferably from 0.1 to 10% by weight.

As radiation polymerizable compounds, there are known radical polymerizable compounds such as photo-curable compounds used in the photopolymerizable composition disclosed in Japanese Patent O.P.I. Publication Nos. 7-159983, 8-224982, and 10-863 and Japanese Patent Publication No. 7-31399, or cation polymerization photocurable compounds. Recently, cation polymerization photocurable resins sensitive to light having a wavelength identical to or longer than that of visible light are disclosed in Japanese Patent O.P.I. Publication Nos. 6-43633 and 8-324137.

The radical polymerizable compound is an ethylenically unsaturated compound capable of being polymerized by a radical, and is any compound, as long as it has at least one ethylenically unsaturated double bond in the molecule. The radical polymerizable compound may have any structure in the form of monomer, oligomer or polymer. The radical polymerizable compound can be used singly or in combination of two or more kinds in any content ratio, according to the objects of the usage. A polyfunctional compound having at least two functional groups is preferable to a monofunctional compound. Use of two kinds or more of the polyfunctional compound is more preferable in controlling physical properties or performance of ink.

The ethylenically unsaturated compound, which is capable of being polymerized by a radical, includes an unsaturated carboxylic acid such as acrylic acid, methacrylic acid, itaconic acid, crotonic acid, isocrotonic acid, or maleic acid or its salt, ester, urethane, amide or anhydride; acrylonitrile; styrene; unsaturated polyesters; unsaturated polyethers; unsaturated polyamides; and unsaturated polyurethanes. The examples include an acrylic acid derivative such as 2-ethylhexyl acrylate, 2-hydroxyethyl acrylate, butoxyethyl acrylate, carbitol acrylate, cyclohexyl acrylate, tetrahydrofurfuryl acrylate, benzyl acrylate, bis(4-acryloxypolyethoxyphenyl)propane, neopentyl glycol diacrylate, 1,6-hexanediol diacrylate, ethylene glycol diacrylate, diethylene glycol diacrylate, triethylene glycol diacrylate, tetraethylene glycol diacrylate, polyethylene glycol diacrylate, polypropylene glycol diacrylate, pentaerythritol triacrylate, pentaerythritol tetraacrylate, dipentaerythritol tetraacrylate, trimethylolpropane triacrylate, tetramethylolmethane tetraacrylate, oligo ester acrylate, N-methylol acryl amide, diacetone acryl amide, or epoxy acrylate; a methacrylic acid derivative such as methyl methacrylate, n-butyl methacrylate, 2-ethylhexyl methacrylate, lauryl methacrylate, allyl methacrylate, glycidyl methacrylate, benzyl methacrylate, dimethylaminomethyl methacrylate, 1,6-hexanediol dimethacrylate, ethylene glycol dimethacrylate, triethylene glycol dimethacrylate, polyethylene glycol dimethacrylate, polypropylene glycol dimethacrylate, trimethylolethane trimethacrylate, trimethylolpropane trimethacrylate, or 2,2-bis (4-methacryloxypolyethoxyphenyl)propane; an allyl compound such as alltl glycidyl ether, diallyl phthalate or triallyl trimellitate; and radical polymerizable or crosslinkable monomers, oligomers or polymers described in S. Yamashita et al., "Crosslinking agent Handbook", Taisei Co., Ltd. (1981), K. Kato et al., "UV, EB Hardenable Handbook (Materials)", Kobunshi Kankokai (1985), Radotek Kenkyukai, "UV, EB Hardening Technology, Application and Market", pp. 79, CMC Co. Ltd. (1989), and E. Takiyama, "Polyester Resin Handbook", Nikkan Kyogyo Shinbunsha (1988). The content of the radical polymerizable compound in ink is preferably from 1 to 97% by weight, and more preferably from 30 to 95% by weight.

Listed as cation polymerizable photo-curable resins may be a monomer (of mainly an epoxy type) which undergoes polymerization due to cationic polymerization, a UV curing prepolymer of an epoxy type, and a prepolymer having at least two epoxy groups in one molecule. Listed as such prepolymers may be, for example, alicyclic polyepoxides, polyglycidyl esters of polybasic acids, polyglycidyl ethers of polyhydric alcohols, polyglycidyl ethers of polyoxyalkylene glycol, polyglycidyl ethers of aromatic polyols, hydrogenated compounds of polyglycidyl ethers of aromatic polyols, urethane polyepoxy compounds and epoxylated polybutadine. Types of these polymers may be employed individually or in combinations of two or more types.

In the polymerizable compound in the invention, a (meth) acrylate type monomer or prepolymer, an epoxy type monomer or prepolymer, or a urethane type monomer or prepolymer, is preferably used. More preferred examples of the polymerizable compound include 2-ethylhexyldiglycolacrylate, 2-hydroxy-3-phenoxypropyl acrylate, 2-hydroxybutyl acrylate, hydroxypivalic acid neopentylglycol acrylate, 2-acryloyloxyethylphtharic acid, methoxypolyethylene glycol acrylate, tetramethylolmethane triacrylate, 2-acryloyloxyethyl-2-hydroxyethylphtharic acid, dimethyloltricyclodecan diacrylate, ethoxylated phenyl acrylate, 2-acryloyloxyethylsuccinic acid, nonylphenol EO adduct acrylate, modified glycerin triacrylate, bisphenol A diglycidyl ether acrylic acid adduct, modified bisphenol A diacrylate, phenoxypolyethylene glycol acrylate, 2-acryloyloxyethylhexahydrophthalic acid, bisphenol A PO adduct diacrylate, bisphenol A EO adduct diacrylate, dipentaerythritol hexacrylate, pentaerythritol triacrylate, tolylenediisocyanateerethane prepolymer, lactone-modified flexible acrylate, butoxyethyl acrylate, propylene glycol diglycidyl ether acrylic acid adduct, pentaerythritol triacrylate hexamethylenediisocyanate urethane prepolymer, 2-hydroxyethyl acrylate, methoxydipropylene glycol acrylate, ditrimethylolpropane tetracrylate, pentaerythritol triacrylate hexamethylenediisocyanate urethane prepolymer, stearyl acrylate, isoamyl acrylate, isomyristyl acrylate, and isostearyl acrylate.

These acrylate compounds are less irritative or susceptible to skin (less poisoned), as compared to conventional polymerizable compound used in UV curable ink. These can lower a viscosity of ink, and can provide stable ink ejecting property, good polymerization sensitivity, and good adhesion to an ink recording medium. The content of the above compound in ink is from 20 to 95% by weight, preferably 50 to 95% by weight, and more preferably 70 to 95% by weight.

The monomers described above, if low molecular weight compounds, are less irritative, and have high reactivity, low viscosity, and excellent permeation or adhesion to the hydrophilic layer.

In order to improve sensitivity, bleeding and adhesion to the hydrophilic layer, a combined use of the monoacryltes described above and a polyfunctional acrylate monomer or polyfunctional acrylate oligomer having a molecular weight of not less than 400, and more preferably not less than 500 is preferred. As oligomers maintaining safety and further improving sensitivity, bleeding and adhesion to the hydrophilic layer, epoxyacrylate oligomer and urethaneacrylate oligomer are preferred.

A combine use of monoacrylates selected from the compounds described above and a polyfunctional acrylate monomer or oligomer is preferred in providing a flexible film, as well as high adhesion and film strength. The monoacrylates are preferably stearyl acrylate, isoamyl acrylate, isomyristyl acrylate, and isostearyl acrylate in providing high sensitivity and low shrinkage, preventing bleeding, minimizing ink odor of printed matter, and reducing cost.

Methacrylates are less irritative to skin than acrylates, but there are no substantial difference between those monomers with respect to susceptibility. Methacrylates have a sensitivity lower than acrylates, and are not suitable to use. However, methacrylate having high sensitivity and low susceptibility can be used. Alkoxyacrylates of the above monomers have problems with respect to sensitivity, bleeding, odor or an exposure source. It is preferred that the content of the alkoxyacrylates is less than 70 parts by weight, and the rest is another acrylate.

The ink used in the invention can contain other additives, as necessary.

When an electron beam or X ray is used as an exposure source, initiators are not needed, but when UV light, visible light or infrared light is used as a light source, radical polymerization initiators, auxiliary initiators, or sensitizing dyes are used according to the respective wavelength of light. The addition amount of these compounds is 1 to 10 parts by weight based on the weight of ink. The initiators include conventional initiators, but are selected from those soluble in the above polymerizable compounds. Examples of the initiators include xanthone or isoxanthone compounds, benzophenone compounds, quinone compounds, and phosphine oxides.

Ink can contain polymerization inhibitors in an amount of 200 to 20000 ppm in order to increase ink storage stability. It is preferred that the ink used in the invention is heated to 40 to 80° C. to lower its viscosity, and ejected. Accordingly, polymerization inhibitors are preferably added to ink in order to prevent clogging of an ink head nozzle.

Besides the above, a surfactant, a leveling agent, a matting agent, and a polyester resin, a polyurethane resin, a vinyl resin, an acryl resin, a rubber resin or waxes for adjusting film properties is optionally added to ink. In order to increase adhesion to a recording medium such as a polyolefin or PET film, a tackifier which does not inhibit polymerization is preferably added to ink. Its typical examples include a high molecular weight sticky polymer disclosed on pages 5 and 6 of Japanese Patent O.P.I. Publication No. 2001-49200 (a copolymer comprising an ester of (meth) acrylic acid with alcohol having an alkyl group having 1 to 20 carbon atoms, an ester of (meth)acrylic acid with an alicyclic alcohol having 3 to 14 carbon atoms, or an ester of (meth)acrylic acid with an aromatic alcohol having 6 to 14 carbon atoms), and low molecular weight stickiness providing resins having a polymerizable unsaturated bond.

In order to improve adhesion to the hydrophilic layer, addition of a minute amount of an organic solvent is effective. The addition of the organic solvent in an amount within the range which does not produce problems in solvent resistance or VOC is effective, and the content of the organic solvent in ink is from 0.1 to 5% and preferably from 0.1 to 3%.

As a means for minimizing lowering of sensitivity due to shielding effect of the colorant used, radical cation hybrid curable ink such as a combination of cation polymerization monomer and an initiator having a long lifetime can be used.

The composition of ink is determined to provide an ink viscosity of preferably from 7 to 30 mPa·s, and more preferably from 7 to 20 mPa·s at an ink ejecting temperature in view of ink ejecting property. The ink viscosity is preferably from 35 to 500 mPa·s, and more preferably from 35 to 200 mPa·s at 25° C. Increase of ink viscosity at room temperature can prevent ink from permeating into a porous layer of an ink recording medium, reduce an uncured monomer and malodor, minimize bleeding, and improve image quality. A viscosity less than 35 mPa·s does not minimize bleeding, and a viscosity exceeding 500 mPa·s causes problem of ink delivery.

The surface tension of ink is preferably from 200 to 300 $\mu$N/cm, and more preferably from 230 to 280 $\mu$N/cm. A surface tension less than 200 $\mu$N/cm has problem in bleeding or permeation, and a surface tension exceeding 300 $\mu$N/cm has problem in wettability.

<<Ink Jet Recording Process>>

In the ink recording process in the invention, it is preferred in ink ejecting stability to eject ink which viscosity is lowered by heating the above ink to 40 to 80° C. Since the radiation curable ink generally has an ink viscosity higher than aqueous inks, its variation of viscosity due to temperature variation is great. The variation of viscosity has a great influence on size of ink droplets or ink ejecting speed, or image quality, and therefore, it is necessary that temperature of the ink is maintained as constant as possible. The temperature of the ink is in the range of a set temperature ±5° C., preferably a set temperature ±2° C., and more preferably a set temperature ±1° C. An ink jet recording apparatus has a means for stabilizing the ink temperature, and the sections in the apparatus where temperature is kept constant are pipe lines and members provided from ink tank (including an intermediate ink tank) to the ink nozzle for ejecting ink.

It is preferred that temperature is controlled according to ink flow rate or environmental temperature by plural temperature sensors provided at each pipe line. It is preferred that the head unit to be heated is thermally shielded or insulated without being influenced by temperature of the apparatus itself or environmental temperature. Further, it is preferred that the heating unit is low in heat content and thermally shielded from another section in order to shorten time necessary to heat or warming up time and reduce loss of heat energy.

As radiations used after ink ejecting, various radiations can be used, for example, UV light, electron beam, X ray, visible light, or infrared light. UV light is preferred in curing ability or cost. UV light sources include a mercury lamp, a metal halide lamp, an excimer lamp, and a UV laser, and an LED.

Fundamental radiation methods are disclosed in Japanese Patent O.P.I. Publication No. 60-132767, where light sources, which are provided on both sides of the head unit, are scanned by a shuttle method, radiation is carried out in a certain time after ink ejecting, and ink curing is completed employing another light source fixed. A method is disclosed in WO 9954415 in which optical fibers are used or collimated UV lights, which are projected on the mirror provided on the side of the head unit and reflected, are used for curing ejected ink. In the invention, these radiation methods can be used. It is preferred in the invention that radiation is carried out from the back of the head unit.

The method in which radiation is carried out from the back of the head unit can rapidly radiate ejected ink without using optical fibers or an expensive optical system. The radiation from the head unit back can prevent ink around ink nozzle from being cured by radiation reflected from an ink jet recording medium. The radiation source is preferably a cingulated source such that the radiation width projected on a recording medium is the same as one scanning.

Typically, a cingulated metal halide lamp tube or UV light lamp tube is preferred. The radiation lamp is fixed and unmovable, which can provide a cheap apparatus structure. In any radiation methods, two radiation sources, a first and second radiation sources are provided. The second radiation source is preferably used for completing ink curing, which contributes to improvement of adhesion between a first ink firstly ejected and a second ink ejected after the first ink, improvement of wettability of the second ink, and cost reduction of the radiation source.

It is preferred that the wavelength or exposure intensity of the first radiation source is different from that of the second radiation source. The radiation energy of the first radiation source is preferably less than that of the second radiation source. The radiation energy of the first radiation source is from 1 to 20%, preferably from 1 to 10%, and more preferably from 1 to 5% of the total energy radiated. The above radiation method can provide a desirable molecular weight distribution of the molecule after cured. When ink having an extremely low ink viscosity such as ink for ink jet recording is used, the method provides a markedly advantageous effect. When high energy radiation is carried out one time, it increases polymerization yield, but produces a polymer with a low molecular weight and cannot obtain high strength of the ink.

The wavelength of the first radiation is longer than that of the second radiation, where the first radiation cures the surface of ink ejected on a recording medium to prevent ink bleeding, and the second radiation cures ink closer to the recording medium, which the first radiation is difficult to reach, to improve ink adhesion to the recording medium.

The ink jet recording process in the invention is characterized in that the ink described above is heated to a constant temperature, ejected on an ink recording medium, and exposed to radiation in 0.01 to 0.5 seconds, preferably 0.01 to 0.3 seconds, and more preferably 0.01 to 0.15 seconds after the ink is ejected on the recording medium. Shortening time from when the ink is ejected on the medium to when the ink is exposed to radiation can prevent ink from bleeding before the ink is hardened. Even when a porous recording medium is used, the method can expose the ink close to the medium, which the radiation is difficult to reach, before the ink is cured, which can reduce the residual unreacted monomer, and malorder. This can provide a great synergic effect in combination with the ink used in the invention. Particularly, ink having a viscosity at 25° C. of from 35 to 500 Pa·s can obtain a great effect. The method described above can keep a dot size of ink constant, which is ejected on various recording media which are different in the surface wettability, resulting in high quality images.

The head unit is comprised of an ink jet nozzle head, an ink supply system, ink, a temperature control system of a head or ink, and a controlling board. In the method in which radiation is carried out from the back of the head unit, projected area of the radiation on a recording medium is preferably less, which the first radiation is effectively carried out.

<<Substrate>>

As the substrate in the invention, those well known in the art as substrates for printing plates can be used. Examples of the substrate include a metal plate, a plastic film, paper treated with polyolefin, and composite materials such as laminates thereof. The thickness of the substrate is not specifically limited as long as a printing plate having the substrate can be mounted on a printing press, and is advantageously from 50 to 500 μm in easily handling.

Examples of the metal plate include iron, stainless steel, and aluminum. Aluminum is especially preferable in its gravity and stiffness. Aluminum is ordinarily used after degreased with an alkali, an acid or a solvent to remove oil on the surface, which has been used when rolled and wound around a spool. The degreasing is carried out preferably employing an aqueous alkali solution. In order to increase adhesion between the substrate and a coating layer, it is preferred that the surface of the substrate is subjected to adhesion increasing treatment or is coated with a subbing layer. For example, the support is immersed in a solution containing silicate or a coupling agent such as a silane coupling agent, or the support is coated with the solution and then sufficiently dried. Anodization treatment is considered to be one kind of adhesion increasing treatment, and can be used. The anodization treatment and the immersing or coating treatment described above can be combined. Aluminum plate, which is surface-roughened with a conventional method, can be used.

Examples of the plastic film include a polyethylene terephthalate film, a polyethylene naphthalate film, a polyimide film, a polyamide film, a polycarbonate film, a polysulfone film, a polyphenylene oxide film, and a cellulose ester film. The plastic film is preferably a polyethylene terephthalate film, or a polyethylene naphthalate film. In order to increase adhesion between the substrate and a coating layer, it is preferred that the surface of the plastic film is subjected to adhesion increasing treatment or is coated with a subbing layer. Examples of the adhesion increasing treatment include corona discharge treatment, flame treatment, plasma treatment and UV light irradiation treatment. The subbing layers include a layer containing gelatin or latex.

The composite support can be obtained suitably laminating the above substrates. Laminating may be carried out before or after forming a coating layer. Further, laminating may be carried out immediately before mounting it on a printing press.

EXAMPLES

The invention will be detailed according to the following examples, but is not limited thereto.

Example 1

<<Preparation of Substrate>>

(Substrate 1)

A 50 μm thick polyethylene terephthalate film (HS 74 produced by Teijin Co., Ltd.) with a subbing layer for an aqueous coating liquid was employed as substrate 1.

(Substrate 2)

A 0.24 mm thick aluminum plate (AA1050) was degreased with an aqueous sodium hydroxide solution, wherein the aluminum dissolution amount was 2 g/m$^2$. The resulting aluminum plate was sufficiently washed with pure water, immersed in a 1% by weight sodium dihydrogen phosphate aqueous solution at 70° C. for 30 seconds, then sufficiently washed with pure water, and dried to obtain substrate 2.

<<Preparation of Printing Plate Precursor Sample for Infrared Laser Exposure>>

(Preparation of a Hydrophilic Layer Coating Liquid)

The materials as shown in Table 2 were sufficiently mixed in the amounts shown in Table 2 while stirring, employing a homogenizer, and filtered to obtain hydrophilic layer coating liquids 1-1 through 1-9.

TABLE 2

| Materials used | Hydrophilic layer coating liquid Nos. | | | | | | | | |
|---|---|---|---|---|---|---|---|---|---|
| | 1-1 | 1-2 | 1-3 | 1-4 | 1-5 | 1-6 | 1-7 | 1-8 | 1-9 |
| *1 | 20.13 | 19.87 | 18.53 | 17.20 | 17.20 | 15.87 | 14.53 | 17.20 | 17.20 |
| *2 | 45.30 | 44.70 | 41.70 | 38.70 | 38.70 | 35.70 | 32.70 | 38.70 | 38.70 |
| *3 | 5.00 | 5.00 | 5.00 | 5.00 | 5.00 | 5.00 | 5.00 | 5.00 | 5.00 |
| *4 | 8.00 | 8.00 | 8.00 | 8.00 | 8.00 | 8.00 | 8.00 | 8.00 | 8.00 |
| *5 | — | 5.00 | 5.00 | 5.00 | 5.00 | 5.00 | 5.00 | 5.00 | 5.00 |
| *6 | 1.00 | 1.00 | 1.00 | 1.00 | 1.00 | 1.00 | 1.00 | 1.00 | 1.00 |
| *7 | 2.40 | 2.40 | 2.40 | 2.40 | 2.40 | 2.40 | 2.40 | 2.40 | 2.40 |
| *8 | — | — | 1.00 | 2.00 | — | — | — | — | — |
| *9 | — | — | — | — | 2.00 | 3.00 | 4.00 | — | — |
| *10 | — | — | — | — | — | — | — | 2.00 | — |
| *11 | — | — | — | — | — | — | — | — | 2.00 |
| Pure water | 18.17 | 14.03 | 17.37 | 20.70 | 20.70 | 24.03 | 27.37 | 20.70 | 20.70 |
| Solid content (% by weight) | 20.00 | 20.00 | 20.00 | 20.00 | 20.00 | 20.00 | 20.00 | 20.00 | 20.00 |

In Table 2, numerical values represent parts by weight, and details of each material are as follows:

*1: Colloidal silica (alkali type): Snowtex S (solid 30% by weight, produced by Nissan Kagaku Co., Ltd.)

*2: Necklace shaped colloidal silica (alkali type): Snowtex PSM (solid 20% by weight, produced by Nissan Kagaku Co., Ltd.)

*3. Cu—Fe—Mn type metal oxide black pigment: TM-3550 black aqueous dispersion {prepared by dispersing TM-3550 black powder having a particle size of 0.1 μm produced by Dainichi Seika Kogyo Co., Ltd. in water to give a solid content of 40.5% by weight (including 0.5% by weight of dispersant)}

*4. Layer structural clay mineral particles: Montmorillonite Mineral Colloid MO gel prepared by vigorously stirring montmorillonite Mineral Colloid MO; gel produced by Southern Clay Products Co., Ltd. (average particle size: 0.1 μm) in water in a homogenizer to give a solid content of 5% by weight

*5. Aqueous 4% by weight sodium carboxymethyl cellulose solution (Reagent produced by Kanto Kagaku Co., Ltd.)

*6. Aqueous 10% by weight sodium phosphate.dodecahydrate solution (Reagent produced by Kanto Kagaku Co., Ltd.)

*7: Porous metal oxide particles Silton AMT 08 (porous aluminosilicate particles having an average particle size of 0.6 μm, produced by Mizusawa Kagaku Co., Ltd.)

*8: Porous metal oxide particles Silton JC 20 (porous aluminosilicate particles having an average particle size of 2 μm, produced by Mizusawa Kagaku Co., Ltd.)

*9: Porous metal oxide particles Silton JC 30 (porous aluminosilicate particles having an average particle size of 3 μm, produced by Mizusawa Kagaku Co., Ltd.)

*10: Porous metal oxide particles Silton JC 40 (porous aluminosilicate particles having an average particle size of 4 μm, produced by Mizusawa Kagaku Co., Ltd.)

*11: Porous metal oxide particles Silton JC 50 (porous aluminosilicate particles having an average particle size of 5 μm, produced by Mizusawa Kagaku Co., Ltd.)

(Preparation of Under Layer Coating Liquid)

The materials as shown in Table 3 were sufficiently mixed in the amounts shown in Table 3 while stirring, employing a homogenizer, and filtered to obtain under layer coating liquids 1-1 through 1-9.

TABLE 3

| Materials used | Under layer coating liquid Nos. | | | | | | | | |
|---|---|---|---|---|---|---|---|---|---|
| | 1-1 | 1-2 | 1-3 | 1-4 | 1-5 | 1-6 | 1-7 | 1-8 | 1-9 |
| *14 | 80.55 | 74.50 | 69.50 | 79.50 | 74.50 | 69.50 | 79.50 | 74.50 | 69.50 |
| *3 | 3.15 | 3.50 | 3.50 | 3.50 | 3.50 | 3.50 | 3.50 | 3.50 | 3.50 |
| *4 | 7.20 | 8.00 | 8.00 | 8.00 | 8.00 | 8.00 | 8.00 | 8.00 | 8.00 |
| *5 | 4.50 | 5.00 | 5.00 | 5.00 | 5.00 | 5.00 | 5.00 | 5.00 | 5.00 |
| *6 | 0.90 | 1.00 | 1.00 | 1.00 | 1.00 | 1.00 | 1.00 | 1.00 | 1.00 |
| *9 | — | 3.00 | 4.00 | — | — | — | — | — | — |
| *10 | — | — | — | 2.00 | 3.00 | 4.00 | — | — | — |
| *11 | — | — | — | — | — | — | 2.00 | 3.00 | 4.00 |
| Pure water | 3.70 | 5.00 | 9.00 | 1.00 | 5.00 | 9.00 | 1.00 | 5.00 | 9.00 |
| Solid content (% by weight) | 18.00 | 20.00 | 20.00 | 20.00 | 20.00 | 20.00 | 20.00 | 20.00 | 20.00 |

In Table 3, numerical values represent parts by weight.

In Table 3, material "*14" is Colloidal silica (alkali type): Snowtex XS (solid 20% by weight, produced by Nissan Kagaku Co., Ltd.).

(Coating of the Under Layer and the Hydrophilic Layer)

The under layer coating liquid as shown in Table 3 was coated on each of the above substrates employing a wire bar, and dried at 100° C. for 3 minutes. Subsequently, the hydrophilic layer coating liquid as shown in Table 2 was coated on the resulting under layer employing a wire bar to provide a combination shown in Table 4, dried at 100° C. for 3 minutes, and further heat-treated at 60° C. for 24 hours to obtain samples 1' through 16'.

The coating was carried out by adjusting a solid content of each coating liquid or by properly selecting kinds of a wire bar to give the average layer thickness (M1 or M2) of each matrix phase as shown in Table 4.

The section of each sample was observed through a scanning electron microscope, and an average thickness M1 or M2 of the hydrophilic matrix phase described in Table 4 in Table 4 was measured. Then, P1−M1 in inequality (1) and P2−(M1+M2) in inequality (2) were calculated, respectively. The results are shown in Table 4.

TABLE 4

| Sample No. | Substrate No. | Under layer Coating liquid | Under layer M2 (μm) | Under layer P2 (μm) | Hydrophilic layer Coating liquid | Hydrophilic layer M1 (μm) | Hydrophilic layer P1 (μm) | P1-M1 (μm) | P2-(M1 + M2) (μm) | Remarks |
|---|---|---|---|---|---|---|---|---|---|---|
| 1' | 2 | — | — | — | 1-5 | 1.5 | 3.0 | 1.5 | — | Inv. |
| 2' | 2 | — | — | — | 1-6 | 1.5 | 3.0 | 1.5 | — | Inv. |
| 3' | 2 | — | — | — | 1-7 | 1.5 | 3.0 | 1.5 | — | Inv. |
| 4' | 2 | — | — | — | 1-8 | 2.0 | 4.0 | 2.0 | — | Inv. |
| 5' | 3 | — | — | — | 1-9 | 3.0 | 5.0 | 2.0 | — | Inv. |
| 6' | 2 | 1-3 | 1.0 | 3.0 | 1-2 | 0.7 | — | — | — | Inv. |
| 7' | 2 | 1-4 | 1.0 | 4.0 | 1-3 | 0.5 | 2.0 | 1.5 | 1.3 | Inv. |
| 8' | 2 | 1-5 | 1.0 | 4.0 | 1-4 | 0.5 | 2.0 | 1.5 | 2.5 | Inv. |
| 9' | 2 | 1-6 | 1.0 | 4.0 | 1-4 | 0.7 | 2.0 | 1.3 | 2.0 | Inv. |
| 10' | 2 | 1-7 | 1.0 | 5.0 | 1-4 | 0.5 | 2.0 | 1.5 | 2.3 | Inv. |
| 11' | 3 | 1-8 | 1.5 | 5.0 | 1-4 | 0.7 | 2.0 | 1.3 | 3.5 | Inv. |
| 12' | 2 | 1-9 | 1.5 | 5.0 | 1-6 | 0.5 | 3.0 | 2.5 | 3.0 | Inv. |
| 13' | 2 | — | — | — | 1-1 | 2.0 | — | — | — | Comp. |
| 14' | 2 | — | — | — | 1-4 | 1.5 | 2.0 | 0.5 | — | Comp. |
| 15' | 2 | 1-1 | 1.0 | — | 1-2 | 1.0 | — | — | — | Comp. |
| 16' | 2 | 1-2 | 1.0 | 3.0 | 1-1 | 1.5 | — | — | 0.5 | Comp. |

Inv.: Invention, Comp.: Comparative

<Measurement and Observation of the Hydrophilic Layer Surface>

Center roughness plane, center line average roughness Ra, density of the effective protrusions, and Rsk of each sample obtained above were measured according to the following procedures:

Measurement was carried out employing a non-contact surface roughness measuring apparatus RST Plus, manufactured by WYKO Co., Ltd., wherein a 1.0 nm thick platinum-rhodium layer had been deposited on the surface of each sample.

In the above, an area of 220 μm×300 μm per one location of each sample was measured at optional five locations by a magnification of 20 (to provide one pixel to be measured of 0.8 μm×0.8 μm). The resulting measurements were subjected to gradient correction, filtration treatment according to "Median Smoothing", and analyzed to obtain data. From the resulting data, center roughness plane, center line average roughness Ra, density of the effective protrusions, and Rsk of each sample were derived. The results are shown in Table 5.

The surface of the hydrophilic layer was observed employing a scanning electron microscope whether a regular convexoconcave structure (unevenness) was formed on the surface.

The results are shown in Table 5 described later.

(Formation of Image Formation Layer)

The following image formation layer coating liquid was coated on the hydrophilic layer of samples 1' through 16' obtained above by a wire bar, and dried at 50° C. for 3 minutes, and further heat-treated at 40° C. for 24 hours to form an image formation layer having a dry coating amount of 0.6 g/m$^2$. Thus, printing plate precursor samples 1 through 16 were obtained.

Regarding samples employing a substrate 1, the resulting sample was adhered to a 190 μm thick aluminum plate with a smooth surface through an adhesive to give a 240 μm thick sample so that the surface of the substrate opposite the hydrophilic layer faces the aluminum plate.

| | |
|---|---|
| Aqueous 5% by weight solution of disaccharide trehalose powder (Trehaose, mp. 97° C., produced by Hayashihara Shoji Co., Ltd.) | 30 parts by weight |
| Dispersion prepared by diluting with pure water carnauba wax emulsion A118 (having a solid content of 40% by weight, the wax having an average particle size of 0.3 μm, a melting viscosity at 140° C. of 0.008 P·s, a softening point of 65° C., and a melting point of 80° C., produced by GifuCerac Co., Ltd.) to give a solid content of 5% by weight | 70 parts by weight |

<<Image Formation According to Infrared Laser Exposure>>

The printing plate precursor sample obtained above was wound around a drum for a laser exposure, fixed on the drum, and were imagewise exposed to an infrared laser (having a wavelength of 830 nm and a beam spot diameter of 8 μm) at an exposure energy of 250 mJ/cm$^2$, at a resolving degree of 4,000 dpi and at a screen line number of 175 to form an image. The term, "dpi" shows the number of dots per 2.54 cm. Thus, an exposed printing plate precursor samples ware obtained.

<<Evaluation of Printing Properties>>

Printing properties of the printing plate precursor samples were evaluated according to the following procedures.

(Printing Method)

The imagewise exposed printing plate precursor sample was mounted on a printing press, DAIYA 1F-1 produced by Mitsubishi Jukogyo Co., Ltd. Printing was carried out employing a coated paper, dampening water a 2% by weight solution of Astromark 3 (produced by Nikken Kagaku Kenkyusyo Co., Ltd.), and printing ink (Toyo King Hyecho M Magenta, produced by Toyo Ink Manufacturing Co.).

(Evaluation of Scratch Resistance)

The surface at unexposed portions of the imagewise exposed printing plate precursor sample obtained above was scratched with a sapphire needle having a tip diameter of 0.3 mm with various loads applied. Employing the resulting printing plate precursor sample, 50 sheets of paper were printed in the same manner as above, and the fiftieth printed sheet of paper was observed. The minimum load at which staining due to scratching was observed on the printed paper sheet was regarded as a measure of scratch resistance.

(Evaluation of Rubber Scratch Resistance)

The surface at unexposed portions of the imagewise exposed printing plate precursor sample obtained above was rubbed with a rubber pen, the tip of which is comprised of a rubber sphere with a diameter of 5 mm, with various loads applied. Employing the resulting printing plate precursor sample, 50 sheets of paper were printed in the same manner as above, and the fiftieth printed sheet of paper was observed. The minimum load at which staining due to rubbing was observed on the printed sheet of paper was regarded as a measure of rubber scratch resistance.

(Evaluation of Printing Durability 1)

Employing the imagewise exposed printing plate precursor obtained above, printing was carried out in the same manner as above, and the number of printed sheets at which loss of 3% dots at image portions or lowering of a density at solid image portions was firstly confirmed, was determined as a measure of printing durability 1.

The above results are shown in Table 5.

TABLE 5

| | Parameters of hydrophilic layer surface | | | Uneven- | Evaluations | | | |
|---|---|---|---|---|---|---|---|---|
| Sample No. | Ra (nm) | Number per mm$^2$ of effective protrusions | Rsk | ness of hydrophilic layer surface | Scratch resistance (g) | Rubber scratch resistance (g) | Printing durability 1 (number of printed sheets) × 10$^4$ | Remarks |
| 1 | 300 | 650 | 1.15 | present | 150 | not less than 400 | 2.0 | Inv. |
| 2 | 350 | 800 | 1.40 | present | 180 | not less than 400 | 2.2 | Inv. |
| 3 | 380 | 1000 | 1.70 | present | 180 | not less than 400 | 2.5 | Inv. |
| 4 | 400 | 700 | 1.30 | present | 150 | not less than 400 | 2.2 | Inv. |
| 5 | 420 | 600 | 1.50 | present | 120 | not less than 400 | 2.5 | Inv. |
| 6 | 320 | 750 | 1.80 | present | 180 | not less than 400 | 2.2 | Inv. |
| 7 | 380 | 1200 | 2.30 | present | not less than 200 | not less than 400 | not less than 3.0 | Inv. |
| 8 | 350 | 1000 | 2.10 | present | not less than 200 | not less than 400 | not less than 3.0 | Inv. |
| 9 | 420 | 1400 | 2.70 | present | not less than 200 | not less than 400 | not less than 3.0 | Inv. |
| 10 | 380 | 1200 | 2.40 | present | not less than 200 | not less than 400 | not less than 3.0 | Inv. |
| 11 | 400 | 1300 | 2.30 | present | 150 | not less than 400 | not less than 3.0 | Inv. |
| 12 | 480 | 1700 | 2.80 | present | not less than 200 | not less than 400 | not less than 3.0 | Inv. |
| 13 | 100 | 0 | 0.02 | absent | 50 | 100 | 0.2 | Comp. |

TABLE 5-continued

| Sample No. | Parameters of hydrophilic layer surface: Ra (nm) | Number per mm$^2$ of effective protrusions | Rsk | Unevenness of hydrophilic layer surface | Evaluations: Scratch resistance (g) | Rubber scratch resistance (g) | Printing durability 1 (number of printed sheets) × $10^4$ | Remarks |
|---|---|---|---|---|---|---|---|---|
| 14 | 250 | 300 | 0.70 | present | 80 | 200 | 0.6 | Comp. |
| 15 | 120 | 20 | 0.40 | present | 50 | 100 | 0.3 | Comp. |
| 16 | 230 | 150 | 0.60 | absent | 80 | 200 | 0.4 | Comp. |

Inv.: Invention,
Comp.: Comparative

As is apparent from Table 5 above, inventive samples having a hydrophilic layer surface (surface roughness and number of effective protrusions) defined in the invention provide excellent scratch resistance, rubber scratch resistance and printing durability as compared with comparative samples.

Example 2

<<Preparation of Printing Plate Precursor for Ink Jet Recording>>

(Preparation of a Hydrophilic Layer Coating Liquid)

The materials as shown in Table 6 were sufficiently mixed in the amounts shown in Table 6 while stirring, employing a homogenizer, and filtered to obtain hydrophilic layer coating liquids 2-1 through 2-3.

TABLE 6

| Materials used | Hydrophilic layer coating liquid Nos. 2-1 | 2-2 | 2-3 |
|---|---|---|---|
| *1 | 22.80 | 19.87 | 18.53 |
| *2 | 51.30 | 44.70 | 41.70 |
| *4 | 8.00 | 8.00 | 8.00 |
| *5 | — | 5.00 | 5.00 |
| *6 | 1.00 | 1.00 | 1.00 |
| *7 | 2.40 | 2.40 | 2.40 |
| *8 | — | 2.00 | — |
| *9 | — | — | 3.00 |
| Pure water | 14.50 | 17.03 | 20.37 |
| Solid content (% by weight) | 20.00 | 20.00 | 20.00 |

(Preparation of an Under Layer Coating Liquid)

The materials as shown in Table 7 were sufficiently mixed in the amounts shown in Table 7 while stirring, employing a homogenizer, and filtered to obtain under layer coating liquids 2-1 through 2-3.

TABLE 7

| Materials used | Under layer coating liquid Nos. 2-1 | 2-2 | 2-3 |
|---|---|---|---|
| *14 | 86.85 | 81.50 | 81.50 |
| *4 | 7.20 | 8.00 | 8.00 |
| *5 | 4.50 | 5.00 | 5.00 |
| *6 | 0.90 | 1.00 | 1.00 |
| *10 | — | 3.00 | — |
| *11 | — | — | 3.00 |
| Pure water | 0.55 | 1.50 | 1.50 |
| Solid content (% by weight) | 18.00 | 20.00 | 20.00 |

(Coating of the Under Layer and the Hydrophilic Layer)

The under layer coating liquid as shown in Table 7 was coated on the following substrate 3 employing a wire bar, and dried at 100° C. for 3 minutes. Subsequently, the hydrophilic layer coating liquid as shown in Table 6 was coated on the resulting under layer employing a wire bar to provide a combination shown in Table 8, dried at 100° C. for 3 minutes, and heat-treated at 60° C. for 24 hours. The coating was carried out by adjusting a solid content of each coating liquid or by properly selecting kinds of a wire bar to give the average layer thickness (M1 or M2) of each matrix phase as shown in Table 8. Thus, printing plate precursor samples 21 through 27 for ink jet recording were prepared.

<Substrate 3>

Polyethylene terephthalate film with a thickness of 188 μm (HS 74, produced by Teijin Co., Ltd.) comprising a subbing layer for coating an aqueous coating solution.

The section of each sample was observed through a scanning electron microscope, and an average thickness M1 or M2 of the hydrophilic matrix phase described in Table 8 was measured. Then, P1−M1 in inequality (1) and P2−(M1+M2) in inequality (2) were calculated, respectively.

(Measurement and Observation of Hydrophilic Layer Surface)

According to the methods described in Example 1, the average roughness Ra, density of effective protrusions and Rsk of the hydrophilic layer surface were measured, and the hydrophilic layer surface was observed.

<<Image Formation According to Ink Jet Process>>

(Preparation of Magenta Ink)

<Preparation of Magenta Pigment Dispersion>

The following components were mixed and the mixture was dispersed to prepare a magenta pigment dispersion. Dispersing was carried out adjusting the dispersing conditions so that the average particle size of magenta pigment particles in the dispersion was 0.2 to 0.3 μm.

| | |
|---|---|
| C.I. Pigment Red 57:1 | 15 parts by weight |
| Polymer dispersant Solsperse, produced by Zeneca Co., Ltd.) | 5 parts by weight |
| Stearyl acrylate | 80 parts by weight |

Subsequently, the following components were mixed, and filtered with a filter with an absolute filtration accuracy of 2 μm to prepare magenta ink. The magenta ink had a viscosity at 25° C. of 120 mPa·s, a viscosity at 70° C. of 15 mPa·s, and a surface tension at 25° C. of 250 μN/cm.

<Magenta ink>

| | |
|---|---|
| Magenta pigment dispersion | 20 parts by weight |
| Stearyl acrylate | 60 parts by weight |
| Difunctional aromatic urethane acrylate (molecular weight 1500) | 10 parts by weight |
| Hexafunctional aromatic urethane acrylate (molecular weight 1000) | 5 parts by weight |
| Initiator (Irgacure 184, produced by Ciba Co., Ltd.) | 5 parts by weight |

<<Image Formation According to an Ink Jet Process>>

Images were printed on each of the printing plate precursor samples obtained above, employing an ink jet recording apparatus equipped with a piezo type ink jet nozzle. The ink supply system was comprised of a first ink tank, an ink supply pipe, a second ink tank provided adjacent to the recording head, a pipe with a filter, and a piezo head, where the section from the second ink tank to the head was a and insulated. A temperature sensor was provided at the second ink tank and adjacent to the nozzle of the piezo head, whereby the nozzle temperature was controlled to be maintained at 60±2° C. The piezo head with a nozzle diameter of 24 $\mu$m was driven so that ink with a multi-size dot of from 8 to 30 pl could be jetted on the printing plate sample at a resolution of 720×720 dpi to form an image on the sample. The formed image was exposed to UV-A light. The exposure, main scanning speed, and jetting frequency were controlled so that exposure intensity at the exposed surface was 100 mW/cm$^2$, and exposure began to be carried out 0.1 seconds after the sample received the jetted ink. The exposure energy was adjusted by varying the exposure time.

The magenta ink prepared above was jetted on the printing plate precursor sample at 25° C. employing the ink jet recording apparatus, and exposed to UV light. The exposure energy was 300 mJ/cm$^2$ at the surface of the printing plate precursor.

<<Evaluation of Printing Properties>>

Printing properties of the printing plate precursor samples prepared above were evaluated in the same manner as in Example 1, except that printing durability 2 described below was evaluated instead of printing durability 1. The results are shown in Table 8.

(Evaluation of Printing Durability 2)

The number of printed sheets at which lowering of a density at solid image portions was firstly confirmed was determined as a measure of printing durability 2.

TABLE 8

| | Under layer | | | Hydrophilic layer | | | | |
|---|---|---|---|---|---|---|---|---|
| Sample No. | Coating liquid | M2 ($\mu$m) | P2 ($\mu$m) | Coating liquid | M1 ($\mu$m) | P1 ($\mu$m) | P1 − M1 ($\mu$m) | P2 − (M1 + M2) ($\mu$m) |
| 21 | — | — | — | 2-3 | 1.2 | 3.0 | 1.8 | — |
| 22 | 2-2 | 1.0 | 4.0 | 2-2 | 0.5 | 2.0 | 1.5 | 2.5 |
| 23 | 2-3 | 1.0 | 5.0 | 2-2 | 0.7 | 2.0 | 1.5 | 3.3 |
| 24 | 2-3 | 1.5 | 5.0 | 2-2 | 0.5 | 2.0 | 2.0 | 3.0 |
| 25 | — | — | — | 2-1 | 2.0 | — | — | — |
| 26 | — | — | — | 2-2 | 1.5 | 0.5 | 0.5 | — |
| 27 | 2-1 | 1.0 | — | 2-1 | 1.0 | — | — | — |

| | Parameters of hydrophilic layer surface | | | Unevenness of | Printing evaluation | |
|---|---|---|---|---|---|---|
| Sample No. | Ra (nm) | Number per mm$^2$ of effective protrusions | Rsk | hydrophilic layer surface | Printing durability 2 (number of printed sheets) × 10$^4$ | Remarks |
| 21 | 320 | 700 | 1.20 | present | 2.0 | Inv. |
| 22 | 340 | 1200 | 2.20 | present | not less than 3.0 | Inv. |
| 23 | 430 | 1650 | 2.70 | present | not less than 3.0 | Inv. |
| 24 | 400 | 1400 | 2.50 | present | not less than 3.0 | Inv. |
| 25 | 100 | 0 | 0.02 | absent | 0.15 | Comp. |
| 26 | 240 | 250 | 0.60 | present | 0.40 | Comp. |
| 27 | 110 | 0 | 0.05 | absent | 0.15 | Comp. |

Inv.: Invention,
Comp.: Comparative

As is apparent from Table 8 above, in the case where a printing plate was prepared according to an ink jet process, inventive samples having a hydrophilic layer surface (surface roughness and number of effective protrusions) defined in the invention provide excellent printing durability as compared with comparative samples.

Effects Of The Invention

The present invention provides a printing plate precursor with a hydrophilic layer providing excellent scratch resistance, rubber scratch resistance and printing durability, the hydrophilic layer corresponding to the grained surface of an aluminum plate, and a printing plate prepared from the precursor.

What is claimed is:

1. A printing plate precursor comprising a substrate and provided thereon, a hydrophilic layer having a center line average roughness Ra of from 150 nm to less than 1000 nm and having effective protrusions of from 500 to less than 3000 per mm$^2$, the effective protrusions protruding from an upper plane 1.0 $\mu$m farther from the substrate than a center roughness plane in a three dimensional roughness plane of the hydrophilic layer, and having a ratio H/D of not less than 0.15, wherein H represents a height ($\mu$m) from the upper plane of the effective protrusions, and D represents a size ($\mu$m) of solids formed by the upper plane and the curved surface protruding from the upper plane of the effective protrusions.

2. The printing plate precursor of claim 1, wherein the surface of the hydrophilic layer has a skewness Rsk exceeding 2.

3. The printing plate precursor of claim 1, wherein the hydrophilic layer contains a hydrophilic matrix phase and inorganic particles or inorganic material coated particles each particle having a particle size of not less than 1 $\mu$m, and satisfies the following inequality (1):

$$P1-M1>1.0 \qquad \text{Inequality (1)}$$

wherein M1 represents an average thickness ($\mu$m) of the hydrophilic matrix phase in the hydrophilic layer, and P1 represents an average particle size ($\mu$m) of the inorganic particles or the inorganic material coated particles contained in the hydrophilic layer.

4. The printing plate precursor of claim 1, further comprising an under layer, wherein the under layer and the hydrophilic layer are provided in that order on the substrate, the under layer containing a hydrophilic matrix phase and inorganic particles or inorganic material coated particles each particle having a particle size of not less than 1 $\mu$m, and the hydrophilic layer containing a hydrophilic matrix phase, wherein the following inequality (2) is satisfied:

$$P2-(M1+M2)>1.0 \qquad \text{Inequality (2)}$$

wherein M1 represents an average thickness ($\mu$m) of the hydrophilic matrix phase in the hydrophilic layer, M2 represents an average thickness ($\mu$m) of the hydrophilic matrix phase in the under layer, and P2 represents an average particle size ($\mu$m) of the inorganic particles or inorganic material coated particles, each particle having a size of not less than 1 $\mu$m contained in the under layer.

5. The printing plate precursor of claim 1, wherein an under layer and the hydrophilic layer are provided in that order on the substrate, both the under layer and the hydrophilic layer containing a hydrophilic matrix phase and inorganic particles or inorganic material coated particles each particle having a particle size of not less than 1 $\mu$m, wherein the following inequalities (1) and (2) are satisfied:

$$P1-M1>1.0 \qquad \text{Inequality (1)}$$

wherein M1 represents an average thickness ($\mu$m) of the hydrophilic matrix phase in the hydrophilic layer, and P1 represents an average particle size (pin) of the inorganic particles or inorganic material coated particles, each particle having a size of not less than 1 $\mu$m contained in the hydrophilic layer, $$P2-(M1+M2)>1.0 \qquad \text{Inequality (2)}$$

wherein M1 represents an average thickness ($\mu$m) of the hydrophilic matrix phase in the hydrophilic layer, M2 represents an average thickness ($\mu$m) of the hydrophilic matrix phase in the under layer, and P2 represents an average particle size ($\mu$m) of the inorganic particles or inorganic material coated particles each particle having a size of not less than 1 $\mu$m contained in the under layer.

6. The printing plate precursor of claim 1, wherein a hydrophilic matrix phase in the hydrophilic layer has a regular convexoconcave structure.

7. The printing plate precursor of claim 1, wherein the hydrophilic layer has a porous structure.

8. The printing plate precursor of claim 1, further comprising on the substrate an image formation layer capable of forming an image by heat application, wherein at least one of the layers provided on the substrate contains a light heat conversion material.

9. The printing plate precursor of claim 8, the image formation layer being provided on the hydrophilic layer, wherein the image formation layer contains heat melting particles or heat fusible particles.

10. The printing plate precursor of claim 8, wherein the image formation layer contains an oligosaccharide.

11. A printing plate comprising a printing plate precursor having a substrate and provided thereon, a hydrophilic layer having a center line average roughness Ra of from 150 nm to less than 1000 nm and having effective protrusions of from 500 to less than 3000 per $mm^2$, the effective protrusions protruding from an upper plane 1.0 $\mu$m farther from the substrate than a center roughness plane in a three dimensional roughness plane of the hydrophilic layer, and having a ratio H/D of not less than 0.15, wherein H represents a height ($\mu$m) from the upper plane of the effective protrusions, and D represents a size ($\mu$m) of solids formed by the upper plane and the curved surface protruding from the upper plane of the effective protrusions; and an image formation material on said hydrophilic layer of said printing plate precursor.

12. The printing plate of claim 11, wherein the image formation material is an ink.

13. The printing plate of claim 12, wherein the ink is a radiation curable ink.

* * * * *